US009883551B2

(12) United States Patent
Widitora et al.

(10) Patent No.: US 9,883,551 B2
(45) Date of Patent: Jan. 30, 2018

(54) INDUCTION HEATING SYSTEM FOR FOOD CONTAINERS AND METHOD

(71) Applicant: Silgan Containers LLC, Woodland Hills, CA (US)

(72) Inventors: Alvin Widitora, Los Angeles, CA (US); Douglas C. Miller, San Ramon, CA (US); George Sadler, Geneva, IL (US); Jianwen Hu, Nashotah, WI (US); Gerald J. Baker, Wauwatosa, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 830 days.

(21) Appl. No.: 13/832,573

(22) Filed: Mar. 15, 2013

(65) Prior Publication Data

US 2014/0263286 A1 Sep. 18, 2014

(51) Int. Cl.

| | |
|---|---|
| ***H05B 6/12*** | (2006.01) |
| ***H05B 6/06*** | (2006.01) |
| ***H05B 6/10*** | (2006.01) |

(52) U.S. Cl.

CPC ..... *H05B 6/06* (2013.01); *H05B 6/107* (2013.01)

(58) Field of Classification Search

CPC ..... H05B 6/105; H05B 6/02; H05B 6/362; H05B 6/365; H05B 6/06; H05B 6/42; C21D 9/60

USPC ..... 219/635, 645, 647, 653, 654, 646, 662, 219/672, 673, 674, 675, 676, 677; 165/61, 64, 65, 58

See application file for complete search history.

(56) References Cited

U.S. PATENT DOCUMENTS

| | | | | |
|---|---|---|---|---|
| 694,131 A * | 2/1902 | Butkus | B65D 39/00 215/362 |
| 2,439,517 A * | 4/1948 | Johnson | H05B 6/103 219/615 |
| 2,752,472 A * | 6/1956 | Emerson | H05B 6/36 219/647 |

(Continued)

FOREIGN PATENT DOCUMENTS

| | | |
|---|---|---|
| CN | 201844538 U * | 5/2011 |
| EP | 0099159 B1 | 1/1984 |

(Continued)

OTHER PUBLICATIONS

U.S. Appl. No. 13/486,660, filed Jun. 1, 2012, Baker et al.

(Continued)

*Primary Examiner* — David Angwin
*Assistant Examiner* — Jimmy Chou
(74) *Attorney, Agent, or Firm* — Reinhart Boerner Van Deuren s.c.

(57) ABSTRACT

An induction heating system configured to sequentially heat a plurality of filled and sealed food containers is provided. The system includes an induction heating coil defining a lumen having a longitudinal axis. The lumen is configured to receive the containers during heating, and the induction coil is configured to generate an alternating magnetic field causing resistive heating of the container. The system includes a container moving device configured to move containers into the induction heating coil lumen prior to heating, to move containers while within the induction heating coil lumen and to move containers out of the induction heating coil lumen after heating.

8 Claims, 21 Drawing Sheets

(56) References Cited

U.S. PATENT DOCUMENTS 2,945,935 A * 7/1960 Messner ..... H05B 6/105 219/628
3,071,478 A * 1/1963 Cheftel ..... A23L 3/022 426/406
3,694,609 A * 9/1972 Kennedy ..... H05B 6/107 219/604
3,723,212 A * 3/1973 Casper ..... B21D 51/26 156/272.4
3,961,150 A * 6/1976 Lewis ..... A23L 3/001 219/618
4,048,473 A * 9/1977 Burkhart ..... A47J 37/047 219/389
4,288,673 A * 9/1981 Ishibashi ..... B29C 35/08 219/633
4,340,801 A * 7/1982 Ishibashi ..... B29C 35/08 156/379.7
4,399,925 A * 8/1983 Fundom ..... B65D 17/165 220/269
4,415,324 A * 11/1983 Henckel ..... B27N 3/143 425/174.8 E
4,539,456 A * 9/1985 Mohr ..... B21D 51/26 156/274.2
4,612,199 A 9/1986 Miyahara
4,696,580 A 9/1987 Kameda
4,739,140 A 4/1988 Reznik
4,817,510 A * 4/1989 Kowalics ..... A47J 27/62 126/374.1
4,828,692 A 5/1989 Peranio
4,948,499 A 8/1990 Peranio
4,971,819 A 11/1990 Miyahara
4,990,347 A 2/1991 Rasmussen et al.
5,064,614 A * 11/1991 Reiss ..... B65B 55/08 422/108
5,114,725 A 5/1992 Leake et al.
5,143,204 A * 9/1992 Owen ..... B65G 21/2063 198/726
5,144,108 A * 9/1992 Passarotto ..... C22B 13/02 219/388
5,182,981 A * 2/1993 Wilcox ..... A23N 12/10 219/389
5,347,107 A * 9/1994 Iguchi ..... H05B 6/1254 219/624
5,386,102 A * 1/1995 Takikawa ..... H05B 6/1227 219/620
5,422,130 A 6/1995 Fox et al.
5,474,227 A * 12/1995 Krengel ..... B05B 13/0618 228/147
5,512,733 A * 4/1996 Takikawa ..... H05B 6/1227 219/620
5,529,703 A * 6/1996 Sprenger ..... B03C 1/253 219/604
5,766,002 A * 6/1998 Silvestrini ..... A23L 3/022 198/413
5,782,339 A * 7/1998 Drewitz ..... B65G 21/2072 198/836.3
5,821,504 A * 10/1998 Sprenger ..... F26B 3/347 219/604
5,847,370 A * 12/1998 Sluka ..... H05B 6/103 219/604
5,869,810 A 2/1999 Reynolds et al.
5,965,086 A 10/1999 Rose et al.
6,177,662 B1 * 1/2001 Rutledge ..... A23L 3/005 219/620
6,295,449 B1 * 9/2001 Westerlage ..... G01D 4/004 455/422.1
6,320,169 B1 * 11/2001 Clothier ..... G06K 7/0008 219/620
6,463,272 B1 * 10/2002 Wallace ..... H04W 88/022 455/404.2
6,721,546 B1 * 4/2004 Compton ..... G08C 17/00 340/10.2
6,725,630 B2 * 4/2004 Rea ..... B29C 65/3656 53/329.3
6,786,672 B2 * 9/2004 Ledingham ..... B65G 21/06 198/836.3
6,967,315 B2 * 11/2005 Centanni ..... A61L 2/07 219/628
7,323,666 B2 * 1/2008 Spohn ..... B32B 27/20 219/620
7,432,480 B2 * 10/2008 Wilson ..... F26B 3/18 219/629
7,497,352 B2 * 3/2009 Segiet ..... G07F 9/105 221/150 A
7,605,349 B2 * 10/2009 Gaynor ..... A47J 27/004 165/47
7,820,947 B2 * 10/2010 Gaynor ..... A47J 27/004 165/47
7,976,887 B2 7/2011 Inoue et al.
8,122,815 B2 * 2/2012 Wolfe ..... A47J 36/165 219/389
8,141,741 B2 * 3/2012 Metzger ..... B65D 7/04 220/672
8,159,340 B2 * 4/2012 Peters ..... H04L 67/12 340/539.22
8,602,248 B2 * 12/2013 Mathieu ..... A47J 27/002 219/620
8,707,862 B1 * 4/2014 Oliver ..... A47J 36/165 99/326
9,060,390 B2 * 6/2015 Rudnev ..... H05B 6/103
2002/0110178 A1 * 8/2002 Puranen ..... G01J 5/02 374/121
2002/0124737 A1 * 9/2002 Bedetti ..... A47J 43/28 99/342
2003/0015523 A1 * 1/2003 Nishinomiya ..... H05B 6/107 219/653
2003/0197007 A1 * 10/2003 Kim ..... H05B 6/105 219/635
2004/0084443 A1 * 5/2004 Ulrich ..... H05B 6/36 219/672
2005/0126124 A1 * 6/2005 Munzer ..... A23L 3/00 53/415
2005/0236385 A1 * 10/2005 Kingdon ..... A21B 1/48 219/388
2006/0186127 A1 8/2006 Gopalaswamy et al.
2006/0219705 A1 * 10/2006 Beier ..... G01D 5/48 219/627
2008/0029505 A1 * 2/2008 Rosenbloom ..... H05B 6/129 219/622
2008/0083730 A1 * 4/2008 Dolgov ..... A47J 27/004 219/432
2008/0257168 A1 * 10/2008 Wolfe ..... A47J 36/165 99/348
2009/0118126 A1 * 5/2009 Burke ..... H05B 6/42 505/211
2009/0173733 A1 * 7/2009 Bogdan ..... H05B 6/76 219/741
2009/0175315 A1 * 7/2009 Schwegman ..... F26B 5/06 374/150
2010/0172795 A1 * 7/2010 Lothar ..... A61L 2/04 422/28
2011/0011852 A1 * 1/2011 Mezquida Gisbert . A23G 9/221 219/672
2011/0083810 A1 * 4/2011 Lin ..... B65B 25/04 156/497
2011/0114634 A1 * 5/2011 Nevarez ..... A47J 37/045 219/725
2011/0123690 A1 * 5/2011 Zavadtsev Koulik .... A23L 2/48 426/234
2011/0220249 A1 * 9/2011 Bogicevic ..... C21D 1/04 148/108
2011/0240633 A1 * 10/2011 Rudnev ..... H05B 6/103 219/653
2011/0259878 A1 * 10/2011 Sadler ..... H05B 6/101 219/632
2012/0063799 A1 * 3/2012 Ueno ..... H05B 6/06 399/67

(56) References Cited

U.S. PATENT DOCUMENTS

| | | | | |
|---|---|---|---|---|
| 2012/0205363 | A1* | 8/2012 | Takatomi | H05B 6/06 219/482 |
| 2012/0293188 | A1* | 11/2012 | Nikolenko | G01B 7/06 324/655 |
| 2013/0272820 | A1 | 10/2013 | Price et al. | |
| 2013/0306661 | A1* | 11/2013 | Baker | B21D 15/06 220/672 |
| 2014/0263287 | A1 | 9/2014 | Widitora et al. | |
| 2014/0335248 | A1 | 11/2014 | Winstanley et al. | |
| 2014/0348987 | A1* | 11/2014 | Cheng | A23L 1/0121 426/231 |
| 2015/0264752 | A1* | 9/2015 | Rosenbloom | H05B 6/129 219/624 |

FOREIGN PATENT DOCUMENTS

| | | | | |
|---|---|---|---|---|
| EP | 0436042 | A1 * | 7/1991 | B65B 55/10 |
| EP | 0 895 719 | | 10/1999 | |
| EP | 2458933 | A1 | 5/2012 | |
| EP | 2747587 | | 7/2014 | |
| FR | 2493682 | | 5/1982 | |
| FR | 2501631 | | 9/1982 | |
| GB | 1441701 | | 7/1976 | |
| GB | 2384478 | | 7/2003 | |
| JP | 10-167225 | | 6/1998 | |
| JP | 10-218130 | | 8/1998 | |
| JP | 2002-199986 | | 7/2002 | |
| JP | 2006-271524 | | 10/2006 | |
| JP | 2012-038621 | A | 2/2012 | |
| JP | 2012038621 | A * | 2/2012 | |
| JP | 2012-130275 | | 7/2012 | |
| WO | WO 95/34469 | | 12/1995 | |
| WO | WO 2012153394 | A1 | 11/2012 | |
| WO | WO 2013/006718 | | 1/2013 | |
| WO | WO 2013/009624 | | 1/2013 | |
| WO | WO 2013/027067 | | 2/2013 | |

OTHER PUBLICATIONS

U.S. Appl. No. 13/725,485, filed Dec. 21, 2012, Baker et al.
U.S. Appl. No. 13/832,533, filed Mar. 15, 2013, Widitora et al.
U.S. Appl. No. 13/834,649, filed Mar. 15, 2013, Gurka et al.
U.S. Appl. No. 13/834,836, filed Mar. 15, 2013, Brewer et al.
Food Production Daily, Joe Whitworth, website newsletter showing article titled "Crown patent to improve canned food processing," dated Mar. 5, 2013, accessed May 31, 2013 at http://mobile.foodproductiondaily.com/Processing/Crown-patent-to-improve-canned-food-processing/?utm_source=newsletter_daily&utm_medium=email&utm_campaign=Newsletter%2BDaily&c=tAAvBv%2FdlUiJjzs9nzczTA%3D%3D#.UTZIEPq9LCQ, 3 pages.
International Search Report and Written Opinion for International Application No. PCT/US2013/042218, dated Dec. 30, 2013, 14 pages.
International Search Report and Written Opinion for International Application No. PCT/US2013/042271 dated Dec. 9, 2013, 10 pages.
Extended European Search Report regarding EP 13878060, dated Nov. 7, 2016, 8 pages.

* cited by examiner

INDUCTION HEATING SYSTEM FOR FOOD CONTAINERS AND METHOD

BACKGROUND OF THE INVENTION

The present invention relates generally to the field of systems and methods for heating food containers. The present invention relates specifically to systems and methods for using induction heating to heat, sterilize and/or cook food in metal or metallic containers. Conventional commercial production of food packaged in metal containers may involve filling a metal can with food, hermetically sealing the can, and heating the can with the food inside to sterilize the food within the can. During one conventional heating procedure, filled, sealed cans are placed within a steam heated, pressurized chamber to heat the cans to the desired sterilization temperature using steam and to maintain the temperature for the desired period of time. The pressurized chamber is filled with super-heated steam which in turn provides the energy to heat the can. In other commercial production processes, sealed and filled food may be heated in systems that do not rely on superheated steam.

SUMMARY OF THE INVENTION

One embodiment of the invention relates to a metallic food can heating system configured to heat a plurality of filled and sealed metallic food cans including an induction heating coil defining an internal lumen having a longitudinal axis. The internal lumen is configured to receive the metallic food cans during heating, and the induction coil is configured to generate an alternating magnetic field causing resistive heating of the metallic material of the food can. The system includes a can moving device configured to move cans into the induction heating coil prior to induction heating, to move cans while within the induction heating coil and to move cans out of the induction heating coil after induction heating. The system includes an electrical induction power supply configured to supply alternating current to the induction heating coil. Each can has a longitudinal axis, and each can is positioned within the lumen of the induction coil such that the longitudinal axis of each can is substantially perpendicular to the longitudinal axis of the internal lumen of the induction heating coil.

Another embodiment of the invention relates to a metal food can heating system configured to sequentially heat a plurality of filled and sealed metal food cans including an induction heating coil defining an internal lumen having a longitudinal axis. The internal lumen is configured to receive the metal food cans during heating, and the induction coil is configured to generate an alternating magnetic field causing resistive heating of the metal of the food can. The system includes a can moving device configured to move cans during heating and an electrical induction power supply configured to supply alternating current to the induction heating coil. The induction heating coil and the electrical induction power supply are configured to raise the temperature of the contents of each of the plurality of cans to a sterilization temperature in less than 180 seconds.

Another embodiment of the invention relates to an induction heating system configured to sequentially heat a plurality of filled and sealed food containers. The system includes an unpressurized heating chamber including an induction heating coil defining a lumen having a longitudinal axis. The lumen is configured to receive the containers during heating, and the induction coil is configured to generate an alternating magnetic field causing resistive heating of the container. The system includes a container moving device configured to move containers into the induction heating coil lumen prior to heating, to move containers while within the induction heating coil lumen and to move containers out of the induction heating coil lumen after heating. The system includes at least one support structure configured to engage an end wall of the container within the induction heating coil lumen during heating of the container, and the support structure resists outward deformation of the end wall during heating.

Another embodiment of the invention relates to a metal food can heating system configured to sequentially heat a plurality of filled and sealed metal food cans. The system includes an induction heating coil defining an internal lumen having a longitudinal axis, and the internal lumen is configured to receive the metal food cans during heating. The induction coil is configured to generate an alternating magnetic field causing resistive heating of the metal of the food can. The system includes a container moving device configured to move cans into the induction heating coil prior to heating, to move cans while within the induction heating coil and to move cans out of the induction heating coil after heating. The system includes an electrical induction power supply configured to supply alternating current to the induction heating coil and a sensor configured to detect a property of a can during heating. The system includes a controller communicably coupled to the sensor and configured to receive a signal from the sensor indicative of the property, and the controller is configured to generate a control signal to at least one of the electrical induction power supply and the container moving device based on the property detected by the sensor.

Another embodiment of the invention relates to a metal food can heating system configured to sequentially heat a plurality of filled and sealed metal food cans. The system includes an induction heating coil defining an internal lumen having a longitudinal axis, and the internal lumen is configured to receive the metal food cans during heating. The induction coil is configured to generate an alternating magnetic field causing resistive heating of the metal of the food can. The system includes a can moving device configured to move cans into the induction heating coil prior to heating, to move cans while within the induction heating coil and to move cans out of the induction heating coil after heating. The system includes an electrical induction power supply configured to supply alternating current to the induction heating coil. The system is configured to impart more than 98% of the electrical energy supplied to the induction heating coil to the contents of each can in the form of heat.

Another embodiment of the invention relates to a real-time temperature detection system for detecting temperature within a metal food can during induction heating. The system includes an induction heating coil generating an alternating magnetic field, and a hermetically sealed metal can positioned within the magnetic field generated by the induction coil. The sealed metal can includes a food product within the sealed metal can, and the magnetic field causes resistive heating of the metal of the sealed metal can. The system includes a rotatable structure engaged with an end wall of the sealed metal can and configured to rotate the sealed metal can about a longitudinal axis of the sealed metal can within the induction heating coil. The system includes a temperature sensing element located within the hermetically sealed can configured to generate a signal indicative of the temperature of the food product during heating. The system includes a wireless transmitter and a lead coupling the temperature sensing element to the wireless transmitter such that the signal indicative of the temperature of the food product during heating is communicated from the temperature sensing element to the wireless transmitter. The system includes a wireless receiver, and the wireless transmitter is configured to transmit data indicative of the temperature of the food product during heating to the wireless receiver, and the wireless receiver is configured to communicate the data indicative of the temperature of the food product during heating to a memory device configured to store data related to the signal received from the temperature sensing element. The temperature sensing element, the lead and the wireless transmitter are rigidly coupled to the sealed metal can and the rotatable structure, such that the temperature sensing element, the lead and the wireless transmitter rotate with the rotatable structure and the sealed metal can as the sealed metal can is rotated within the induction coil.

Another embodiment of the invention relates to a temperature detection system for detecting temperature within a metallic can during heating. The system including an induction heating coil configured to generate an alternating magnetic field and a hermetically sealed can positioned within the magnetic field generated by the induction coil. At least a portion of the sealed can is formed from a metallic material, and the sealed can includes a food product within the can. The magnetic field causes resistive heating of the metallic material of the sealed can. The system includes a temperature sensing element located within the sealed can configured to generate a signal indicative of the temperature of the food product during heating. The system includes a memory device communicably coupled to the temperature sensing element configured to store data related to the signal received from the temperature sensing element.

Another embodiment of the invention relates to a method of detecting temperature of food within a hermetically sealed metal can. The method includes heating food within the sealed metal can using a magnetic field generated by an induction coil. The method includes sensing the temperature of the food within the sealed metal can while the sealed metal can is being heated inside the magnetic field. The method includes transmitting a signal indicative of the temperature of the food out of the sealed metal can and out from the magnetic field. The method includes receiving the signal indicative of the temperature of the food at a receiver. The method includes recording data indicative of the temperature of the food.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a system for heating, cooking and/or sterilizing filled and sealed food containers using induction heating are shown. Typically, the food containers discussed herein are filled and sealed metal food cans Generally, the systems disclosed herein includes an induction coil and at least one metal or metallic food can located within the induction coil. The induction coil generates an alternating magnetic field which induces a corresponding current (e.g., eddy currents) within the metal of the can (e.g., a steel can sidewall and a steel can end). The induced current results in resistive heating of the metal portions of the can body, and the heat generated is then transferred (e.g., by conduction and/or convection) throughout the container to heat the contents of the container to the desired temperature. It is believed that utilization of induction heating including one or more of the embodiments discussed below may significantly improve heating efficiency. For example, in some heating system embodiments discussed herein, up to approximately 99% of the electrical energy used to create the magnetic field is converted to heat within the contents of the can.

Figure 1:
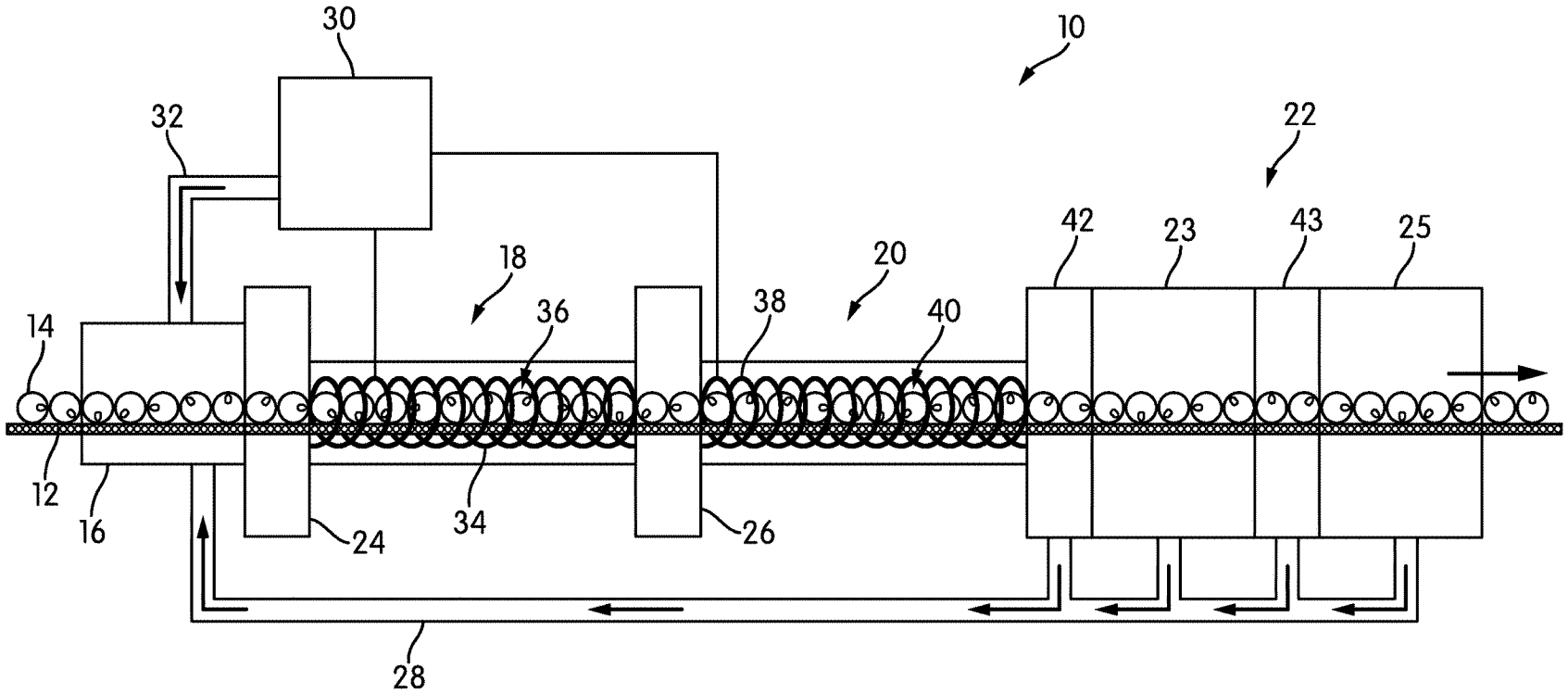
FIG. 1 is a can heating system according to an exemplary embodiment.

Referring to FIG. 1, a can heating system 10 is shown according to an exemplary embodiment. System 10 includes a container mover or can mover, shown as conveyor 12, that is configured to move cans 14 through the various portions of system 10. In the embodiment shown in FIG. 1, a plurality of cans 14 are shown located next to each other along conveyor 12, such that each can 14 moves sequentially through the various sections of system 10. In the exemplary embodiment shown, system 10 includes a preheating section, shown as preheating chamber 16, a first heating section, shown as heating chamber 18, a second heating section, shown as heating chamber 20, and a cooling section, shown as cooling chamber 22. In one embodiment, one or both of heating chambers 18 and 20 are pressurized heating chambers, and in these embodiments, a first airlock 24 is located between preheating chamber 16 and heating chamber 18, and a second airlock 26 is located between heating chamber 18 and heating chamber 20. In embodiments of system 10 in which heating chambers 18 and 20 are not pressurized no airlocks are needed. In another embodiment, system 10 does not include preheating chamber 16 and only includes a single induction heating chamber 18.

Whether pressurization of heating chamber 18 and/or 20 is desirable in a heating system embodiment may depend on one or more different factors or considerations. For example, whether a heating chamber is pressurized will depend upon whether the can is physically constrained from expanding due to heating within the chamber and/or upon the amount or degree of temperature increase of the can contents provided by the particular heating chamber. In various embodiments, chamber 18 and/or 20 may be unpressurized chambers that are configured to heat the cans within the chamber to a maximum temperature such that the pressure of the contents within the can at the maximum temperature does not rupture, break or permanently deform the body of the can within the heating chamber at atmospheric pressure (i.e., without a pressurized chamber). In some embodiments, as discussed below, physical support structures may engage the can body (e.g., the end walls of the can to resist deformation, the sidewalls to resist deformation). In other embodiments, the heating chambers discussed herein are unpressurized induction heating chambers and the cans (e.g., cans 14) heated within the induction coils are configured with a can end wall that expands elastically outward upon heating to relieve the internal heating pressure, and to remain outwardly extended until a punch or other machine pushes the end wall back in following heating. Various embodiments of such a can having an expanding end wall are disclosed in U.S. application Ser. No. 13/834,836, titled "Container with Concentric Segmented Can Bottom," filed on Mar. 15, 2013, the entirety of which is incorporated herein by reference.

Further, if chamber 18 and/or 20 are pressurized, the pressure level within chamber 18 and/or 20 is selected such that the pressure within the chamber does not compress or deform the cool can inwardly upon entry into the pressurized chamber. Compression or deformation of the cool can upon entry into a pressurized chamber may occur because the cool can does not yet have the higher internal pressure that results from the heated contents to counteract the inwardly directed force generated by the pressure within a pressurized heating chamber. In various embodiments, the can to be heated is a thin-walled can or another can design potentially susceptible to deformation or collapse if the pressure within the heating chamber is high enough to compress the can prior to heating, and in such embodiments, pressure within the heating chamber is selected such that the can does not deform inwardly when cool and does not deform outwardly when heated.

Preheating chamber 16 is an initial heating area configured to raise the temperature of cans 14 above ambient temperature prior to the cans entering the primary heating chambers (e.g., heating chambers 18 and 20). In the embodiment shown, preheating chamber 16 heats cans 14 using a non-induction heat sources (e.g., heat supplied from recycling heat from other portions of the system). The preheating provided by preheating chamber 16 lessens the amount of heating that must be applied to cans 14 within heating sections 18 and 20. To raise cans 14 above ambient temperature preheating chamber 16 is maintained at a temperature above ambient temperature, but is generally lower than the cooking temperature or lower than the sterilization temperature of cans 14. In one embodiment, the temperature within preheating chamber 16 is above ambient temperature in the location of system 10. In various embodiments, the temperature within preheating chamber 16 is between 70 and 212 degrees Fahrenheit, specifically is between 90 and 170 degrees Fahrenheit, and more specifically is between 110 and 150 degrees Fahrenheit.

As shown in FIG. 1, preheating chamber 16 includes one or more passive heat sources. In some embodiments, the passive heat sources transfer excess heat from one section of system 10 into preheating chamber 16 providing energy to preheat cans 14 within chamber 16. In one embodiment, system 10 includes a conduit 28 which transfers heat (e.g., heat air, heated water, other heated fluid, etc.) from cooling chamber 22 to preheating chamber 16. Thus, in this embodiment, heat from cooling cans 14 within cooling chamber 22 is captured and transferred from cooling chamber 22 into preheating chamber 16 via conduit 28. In addition, as explained in more detail below, system 10 may include a helical coil cooling system 30, and excess heat generated by helical coil cooling system 30 is transferred to preheating chamber 16 via a second conduit 32. Preheating cans 14 within preheating chamber 16 utilizing excess heat from other portions of system 10 may reduce the amount of energy needed to heat within heating chambers 18 and 20.

In another embodiment, preheating chamber 16 may include an induction heating coil to preheat cans 14 prior to entering the primary heating chambers. Further, in another embodiment, preheating chamber 16 may be a preheating chamber to preheat cans 14 prior to entering a non-induction based heating system (e.g., a retort). In such an embodiment, preheating chamber 16 is located before a superheated steam based and pressurized heating chamber.

As cans 14 exit preheating chamber 16, they move sequentially into first airlock 24. Airlock 24 provides an airtight region located between the high pressure environment of heat chamber 18 and the atmospheric pressure of preheating chamber 16. Specifically, airlock 24 acts to prevent excessive escape of air and depressurization of heat chamber 18 as cans 14 move into heat chamber 18. In one embodiment, airlock 24 includes an entry door located between preheating chamber 16 and airlock 24 and an exit door located between preheating chamber 16 and heating chamber 18. In this embodiment, the entry and exit doors alternate between open and closed positions allowing cans 14 to enter and exit airlock 24 without causing significant depressurization of heating chamber 18. In another embodiment, airlock 24 is a rotating wheel airlock that includes multiple can compartments that rotate sequentially around the axis of the air lock. During operation of the rotating wheel airlock, one of the can compartments is open to preheating chamber 16 to receive a can 14 into the airlock and the other can compartments and heating chamber 18 is sealed from preheating chamber 16. Following entry of the can into the compartment the wheel-style airlock, the wheel rotates bringing can 14 into the entrance to heating chamber 18, and the cycle repeats for each can.

Generally, heating chamber 18 is a pressurized structure that includes a first induction heating coil, shown as helical induction coil 34. Helical coil 34 is shown surrounding (e.g., wrapping around) conveyor 12 such that conveyor 12 passes through a central lumen 36 or passage defined by the inner surface of helical coil 34. In the embodiment shown, central lumen 36 is a substantially cylindrical space bounded by coil 34. Cans 14 exit airlock 24 and move through the lumen of helical coil 34 on conveyor 12 such that cans 14 move sequentially through heating chamber 18.

Coil 34 is a coil formed from an electrically conductive material (e.g., copper, hollow copper tube, etc.) such that application of an alternating current to coil 34 generates an alternating magnetic field within lumen 36 of coil 34. In the embodiment shown, cans 14 are made from a electrically conductive material, specifically a metal material, such that the magnetic field generated within coil 34 induces current (e.g., eddy currents) within the body and/or end walls (e.g., end panels of a three piece can, an integral end wall of a two piece can, etc.) of cans 14. In one embodiment, cans 14 are made from an iron-based material, and in a specific embodiment, cans 14 are made from a steel material. In another embodiment, cans 14 may be formed from a non-electrically conductive material (e.g., a plastic material) with embedded electrically conductive structures and/or suseptors (i.e., embedded material or elements which can have current induced by coil 34 and which generates heat via resistive heating). The induced current causes resistive heating of the body and end walls of cans 14, which in turn heats the contents of can 14.

Because cans 14 are hermetically sealed cans, as the contents of can 14 heat up, the pressure within each can 14 increases which exerts outwardly directed forces on the body and end walls of cans 14. Heating chamber 18 is pressurized such that the pressure within heating chamber 18 is above atmospheric pressure and is greater than the air pressure within preheating chamber 16. The increased pressure within heating chamber 18 acts to resist or counterbalance the increase of pressure within cans 14 as they are heated within induction coil 34 such that the net outward force acting on the body and/or end walls of cans 14 is less than the burst strength (i.e., the force at which either the body or end walls of cans 14 will fail, crack, rupture, etc.) of the body and end walls of cans 14. Thus, the pressure within heating chamber 18 is a function of the temperature to which the contents of cans 14 are heated to inside induction coil 34, the physical properties of the contents of cans 14 and the strength of the body and end walls of cans 14. In one embodiment, heating chamber 18 is configured to heat the contents of cans 14 to between 230 degrees and 260 degrees Fahrenheit, and is configured to be pressurized to between 10 psi and 25 psi. In another embodiment, heating chamber 18 is configured to heat the contents of cans 14 to between 217 degrees and 310 degrees Fahrenheit, and is configured to be pressurized to between 15 psi and 90 psi. In one embodiment, heating chamber 18 is part of system for heating high acid foods and is configured to heat the contents of cans 14 to between 170 degrees and 195 degrees Fahrenheit, and in this embodiment, chamber 18 is not pressurized.

In the embodiment shown in FIG. 1, system 10 includes a second heating chamber, shown as heating chamber 20. Heating chamber 20 includes a second induction heating coil, shown as helical induction coil 38, defining a lumen 40. Heating chamber 20 and coil 38 function substantially the same as heating chamber 18 and coil 34 discussed above, such that cans 14 are heated by the resistive heating of the can body and/or end walls of cans 14 within the alternating magnetic field generated by coil 38.

In one embodiment, heating chamber 20 is configured to heat cans 14 to a higher temperature than heating chamber 18 to finish the cooking and/or sterilization of cans 14. Thus, in such embodiments, heating chamber 20 is configured to continue the heating started by heating chamber 18. In such embodiments, heating chamber 20 is configured to finish heating the contents of cans 14 to between 230 degrees and 260 degrees Fahrenheit, and is configured to be pressurized to between 10 psi and 25 psi. In another embodiment, heating chamber 20 is configured to finish heating the contents of cans 14 to between 217 degrees and 310 degrees Fahrenheit, and is configured to be pressurized to between 15 psi and 90 psi. In one embodiment, heating chamber 20 is part of system for heating high acid foods and is configured to heat the contents of cans 14 to between 170 degrees and 195 degrees Fahrenheit, and in this embodiment, chamber 20 is not pressurized. Higher heating may be accomplished within chamber 20 by varying the heating properties of coil 38. For example, in one embodiment, the coil density of coil 38 (i.e., the number of rotations of coil per unit length of coil) is greater than the coil density of coil 34. In another embodiment, the frequency of the current within coil 38 (and consequently the frequency of the alternating magnetic field) and/or the amount of current within coil 38 is greater than the frequency and/or current within coil 34.

In various embodiments, sealed cans 14 may be subjected to induction heating within the induction coil of chamber 18 and/or 20 for between 10 seconds and 4 minutes, specifically between 15 seconds and 3 minutes, and more specifically between 20 seconds and 2 minutes. Then, following heating for the selected time, the can may be removed from the induction field to allow the heat imparted to the can while within the induction coil to transfer throughout the contents of the can to finish heating of the contents.

As shown in FIG. 1, conveyor 12 carries cans 14 through lumens 36 and 40 of induction coils 34 and 38, respectively. In this configuration, the portions of conveyor 12 located within coils 34 and 38 are formed from a non-electrically conductive material. Specifically, conveyor 12 may be formed from high strength, temperature tolerant polymer materials.

In those embodiments in which cans are heated to a higher temperature in chamber 20, the pressure within heating chamber 20 may also be greater than the pressure within heating chamber 18 to account for the higher temperature of the can contents and the resulting higher internal pressure within cans 14 when heated within heating chamber 20. Airlock 26 is located between heating chambers 18 and 20 to account for the rise in pressure between heating chambers 18 and 20 and to provide movement of cans 14 between chambers without triggering depressurization of chamber 20.

A third airlock, shown as airlock 42, is located at the exit of heating chamber 20 and between heating chamber 20 and cooling chamber 22. Cooling chamber 22 is a chamber that holds cans 14 while the cans cool to a temperature suitable for handling and processing upon exiting system 10. Similar to airlocks 24 and 26 discussed above, airlock 42 acts to prevent the loss of pressure from chamber 20 as cans are moved out of heating chamber 20 and into cooling chamber 22.

In the embodiment shown cooling chamber 22 includes two separate, sub-cooling chambers, shown as pressurized cooling chamber 23, and unpressurized cooling chamber 25. Pressurized cooling chamber 23 is pressurized at a level less than heating chamber 20, but at a higher air pressure than unpressurized cooling chamber 25. Accordingly, a fourth airlock 43 is located between pressurized cooling chamber 23 and unpressurized cooling chamber 25 such that airlock 43 acts to prevent the loss of pressure from chamber 23 as cans are moved out of pressurized cooling chamber 23 and into unpressurized cooling chamber 25. In one embodiment, pressurized cooling chamber 23 is maintained at the same pressure as heating chamber 20, and in this embodiment, system 10 does not include an airlock between heating chamber 20 and pressurized cooling chamber 23.

As shown in FIG. 1, system 10 includes an induction coil cooling system 30. Induction coil cooling system 30 acts to cool coils 34 and 38 during heating. Cooling of coils 34 and 38 helps to lower the resistance of the material of the coils and consequently also lowers the power consumption during generation of the magnetic fields resulting in higher heating efficiencies. In various embodiments, coil cooling system 30 includes a helical conduit that surrounds coils 34 and 38 and provides a channel for supplying cooling fluid to the outer surface of coils 34 and 38. In one embodiment, the cooling fluid is cooled air, and in another embodiment the cooling fluid is a liquid such as water. After extracting heat from coils 34 and/or 38, the cooling fluid (now heated from coils 34 and/or 38) is redirected to preheating chamber 16 where the extracted heat from the coils acts to raise the temperature within preheating chamber 16. In various embodiments coil cooling system 30 is a refrigeration system (e.g., a compressor-based system), and in this embodiment, induction coil cooling system 30 is a closed circuit moving cooling fluid along coils 34 and 38. In such an embodiment, the heat generated by the components (e.g., the compressor) of the refrigeration system is supplied to preheating chamber 16 via conduit 32 to raise the temperature within preheating chamber 16.

The geometry of coils 34 and 38 may be selected to improve or maximize current induction within cans 14. For example, the coil density (i.e., the number of coil rotations per unit distance), the coil diameter, and the cross-sectional shape of the helical coil (e.g., circular, elliptical, rectangular, square, etc.) may be selected to improve current induction for a particular application. For example, as shown in FIG. 1, coils 34 and 38 are round or circular helical coils. However, in other embodiments other shapes or types of induction coils can be used. For example, in one embodiment, coils 34 and 38 are square or rectangular shaped coils. In addition as discussed in more detail below regarding FIG. 2C, in one embodiment, the cross-sectional geometry of the induction coil is a non-regular shape.

While FIG. 1, shows system 10 including two separate pressurized heating sections, system 10 may include more or less than two heating sections. System 10 may include more than two heating sections to heat products that require, for example, higher heating temperatures, longer heating times and/or alternating cycles of high heat, low heat and/or no heat. In other embodiments, system 10 may include a single heating chamber, such as either heating chamber 18 or 20, configured to heat cans 14 to the desired temperature for a particular product or application.

In steam based heating systems multiple chambers at different pressures are typically needed because pressure and temperature are interrelated in steam based heating systems (e.g., higher temperature produces higher pressure). In contrast to steam systems, system 10 utilizing induction coil heating allows that the temperature of cans 14 to be controlled (e.g., actively controlled) independent of pressure within the heating chamber. Thus, system 10 allows the pressure within the heating chamber to be selected to counteract the internal pressure within the heated can without pressure being tied to the heating temperature of the heating chamber. In some embodiments, pressure within the heating chamber only needs to counteract internal pressure such that the net force on the can is less than the burst force or permanent deformation force of the can. Thus, in these embodiments, the pressure within the heating chamber (e.g., heating chambers 18 and 20) is greater than atmospheric pressure and may different (more or less) than pressure that would be required to maintain steam at the cooking temperature within can 14 (given a fixed volume within the heating chamber). Further, because the heating temperature within the induction coil-based heating chambers is not dependent on an elevated pressure within the heating chamber, use of the induction heating coils discussed herein allows for the heating chamber to be unpressurized in some embodiments. In such embodiments, as discussed below, other mechanisms for counteracting the increase in internal pressure with the heated container, such as a physical support structure, physical restraint structure and/or counteracting can structures, can be used instead of increased pressure.

System 10 is configured to provide efficient heating of cans 14 utilizing one or more induction coils, such as coil 34 or coil 38. For example, as discussed above, conduits 28 and 32 transfer excess heat from other sections of system 10 into preheating chamber 16 to preheat cans 14 prior to entry to the main heating chambers.

In addition, conveyor 12 may be configured to facilitate transfer of heat from the can body and/or end walls of cans 14 through the contents of can 14. In one embodiment, conveyor 12 is configured to cause rotation of cans 14 about the longitudinal axis of each can, as cans 14 move through at least heating sections 18 and 20. It should be understood, that as used herein the longitudinal axis of cans 14 is the axis of the can perpendicular to and passing through the center point of the can end wall of each can. In various embodiments, conveyor 12 may be configured to rotate cans about the can's longitudinal axis at relatively fast rotational rates. In various embodiments, conveyor 12 is configured to rotate cans about the can's longitudinal axis at a speed greater than 200 rpm, specifically between 200 rpm and 600 rpm, and more specifically between 300 rpm and 500 rpm. In more specific embodiments, conveyor 12 is configured to rotate cans about the can's longitudinal axis at a speed between 350 rpm and 450 rpm and more specifically at about 400 rpm. In another embodiment, conveyor 12 is configured to rotate cans about the can's longitudinal axis at a speed greater than 50 rpm, between 50 rpm and 600 rpm, and more specifically between 50 rpm and 300 rpm. In more specific embodiments, conveyor 12 is configured to rotate cans about the can's longitudinal axis at a speed between 50 rpm and 200 rpm, and more specifically between about 100 rpm and 200 rpm. In another embodiment, conveyor 12 is configured to rotate cans about the can's longitudinal axis at a speed between 80 rpm and 600 rpm.

In addition, conveyor 12 may be configured to oscillate or agitate cans 14 to facilitate heat transfer within the contents of the can. The oscillation or agitation generated by conveyor 12 may be provided in addition to or in place of rotation of cans 14. In one embodiment, conveyor 12 is configured to cause end over tumbling and/or twisting of cans 14 as cans move along conveyor 12.

In various embodiments, system 10 is configured to orient cans 14 within induction coils 34 and 38 and consequently, to orient cans 14 relative to the magnetic field generated by the induction coils 34 and 38 in a manner that increases the heating efficiency between the interaction of the magnetic field and the electrically conductive metal material of cans 14. FIG. 1 depicts an exemplary embodiment of one such orientation. As shown in FIG. 1, cans 14 are positioned such that the longitudinal axis of cans 14 is substantially perpendicular (e.g., within 10 degrees of perpendicular, and in another embodiment, within 5 degrees of perpendicular) to the longitudinal axis of coils 34 and 38. It is believed that this orientation exposes a greater volume of metal within the body and end walls of cans 14 to interaction (i.e., magnetic coupling) with the magnetic fields generated by coils 34 and 38 which in turns results in results in better can heating than some other potential orientations.

Figure 2A:
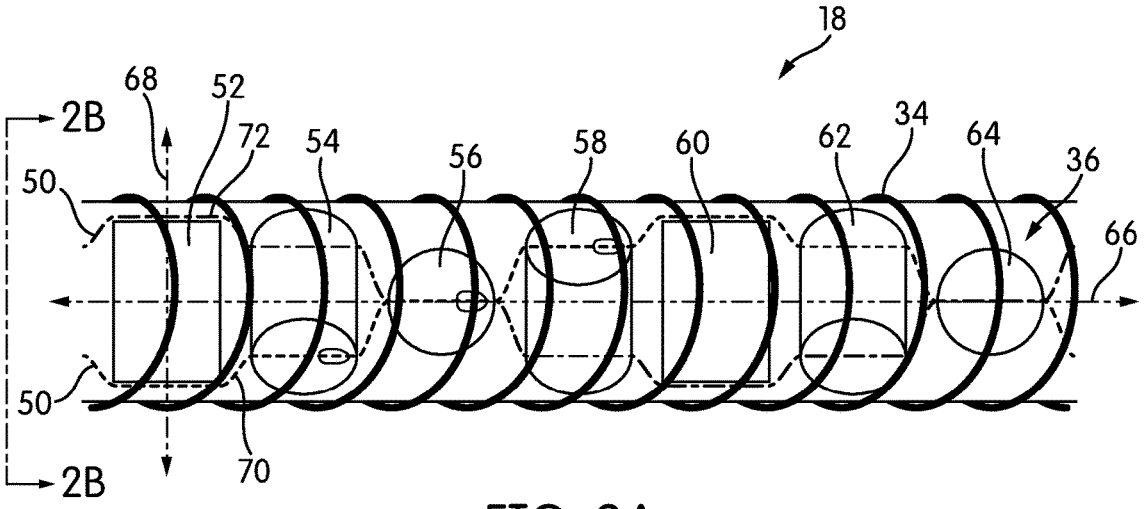
FIG. 2A is an induction heating coil according to an exemplary embodiment.
Figure 2B:
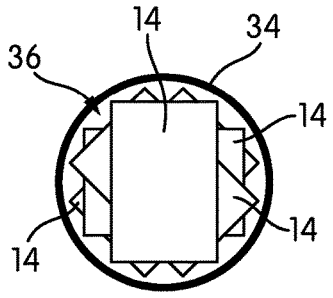
FIG. 2B is an end view of the induction heating coil of FIG. 2A according to an exemplary embodiment.

Referring to FIGS. 2A and 2B, an exemplary embodiment of a heating section, such as heating section 18 or heating section 20, is shown. According to an exemplary embodiment, one or more heating sections of system 10 may include a can mover that is configured such that the rotational position of the longitudinal axis of cans 14 within lumen 36 of coil 34 is varied at different longitudinal positions within coil 34. As shown, cans 14 have a number of rotational positions, shown as positions 52, 54, 56, 58, 60, 62 and 64, at different longitudinal positions though heating coil 34. It should be noted that in all of the rotational positions of cans 14, the longitudinal axis of cans 14, shown as axis 68, is substantially perpendicular to the longitudinal axis of coil 34, shown as axis 66, and that it is the angle between axis 66 and 68 within the plane of intersection of axis 66 and 68 that varies to define the different rotational positions of can 14 shown in FIG. 2A.

In one embodiment, the can mover shown in FIG. 2A is configured to vary the rotational position of each can 14 as it moves through coil 34. In this embodiment, each can 14 is rotated as it moves through coil 34 such that each can assumes positions 52, 54, 56, 58, 60, 62 and 64 (and all intermediate positions), as it moves through coil 34. In another embodiment, each can 14 enters coil 34 with a different rotational position (such as positions 52, 54, 56, 58, 60, 62 and 64) and the position of a single can 14 does not vary as the can moves through coil 34. In this embodiment, each of the positions 52, 54, 56, 58, 60, 62 and 64 represent a different can 14 within coil 34.

FIG. 2B shows a schematic end view of coil 34 showing the different rotational positions of cans 14 within coil 34. As shown in FIG. 2B, by varying the rotational position of cans 14 along the length of coil 34, cans 14 are positioned to obstruct more of the path of the magnetic field through lumen 36 than if all cans 14 had the same rotational position relative to the longitudinal axis of coil 34 (as shown for example in FIG. 1). Because the magnetic field generated by coil 34 extends through lumen 36 of coil 34, the positioning of cans 14 shown in FIGS. 2A and 2B allows more of the magnetic field to interact with the metal of cans 14 to heat cans 14. In other words, the positioning shown in FIGS. 2A and 2B exposes more metal of cans 14 to more of the magnetic field generated by coil 34, than if all of cans 14 were in the same rotational position. By utilizing more of the magnetic field generated by coil 34 to induce current into and to heat cans 14, varying the rotational position of cans 14 is believed to improve the heating efficiency of coil 34.

Coil diameter and/or confirmation may be selected to increase the proportion of the magnetic field allowed to interact with the body of cans 14. The coil diameter may be selected so that the area of can sidewall material exposed to the magnetic field (e.g., the area of overlapping can sidewalls perpendicular to the longitudinal axis of the coil as shown in FIG. 2B) fills a substantial proportion of the cross-sectional area of the coil. For example as shown in FIG. 2B, the diameter of coil 34 is selected such that the area of can sidewall perpendicular to the longitudinal axis of coil is greater than 70% of the cross-sectional area of coil 34, specifically is greater than 80% of the cross-sectional area of coil 34, and more specifically is greater than 90% of the cross-sectional area of coil 34.

Various can movers can be employed to achieve the variable positioning shown in FIGS. 2A and 2B. By way of example, FIG. 2A specifically shows heating section 18 including a can mover, shown schematically as tracks 50, that is configured such that the rotational position of each can 14 within lumen 36 of coil 34 is varied as the can moves through lumen 36. It should be understood, that in the embodiment of FIG. 2A, tracks 50 form the portion of conveyor 12 that moves the cans through the heating section such that cans 14 may leave the belt type conveyor depicted in FIG. 1 and enter tracks 50 as the cans enter heating sections 18 and/or 20, and cans 14 may then be placed on a belt type conveyor as cans 14 exit the heating sections and pass into cooling chamber 22.

Generally, tracks 50 include a pair of opposing generally helically coiled tracks 70 and 72. Each can 14 is gripped on one end wall by track 70 and on the other end wall by track 72. As each can 14 is advanced along the helical path of tracks 70 and 72, the rotational position of cans 14 is varied as shown in FIG. 2A. In one embodiment as discussed in more detail regarding FIGS. 7 and 8, the gripping mechanism of tracks 70 and 72 are configured to apply an inwardly directed force to the end walls and to resist the outward pressure generated as the can contents are heated within sealed can 14.

Figure 2C:
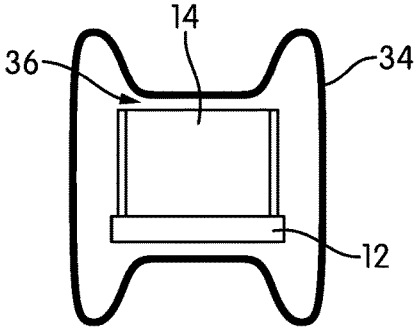
FIG. 2C is an end view of an induction heating coil according to an exemplary embodiment.

Referring to FIG. 2C, a non-regular shaped version of an induction coil 34 is shown. FIG. 2C is an end view of a heating coil showing a can 14 located on a conveyor 12 within lumen 36 of coil 34. Coil 34 in FIG. 2C operates to heat can 14 in much the same way as the versions of coil 34 discussed above except that instead of being a circular helix, coil 34 is an irregular helix having the general shape shown in FIG. 2C. In this embodiment, coil 34 has flared or expanded lateral sections 44 and a central section 46. In the orientation shown in FIG. 2C, the heights of lateral sections 44 are greater than the height of central section 46. Thus, in this embodiment coil 34 has four transition sections that slope inwardly toward can 14 to join to central section 46 (two of the transition sections join to an upper central coil segment and two of the transition section join to a lower central coil segment). In addition the width of central section 46 (i.e., the horizontal dimension in the orientation of FIG. 2C) is less than the axial distance (i.e., horizontal distance) between the end seams of can 14. Thus, in this embodiment coil 34 is configured to focus heating on the sidewalls of can 14 and to limit or reduce the heating that occurs at the end seams (e.g., double seams) or at the can end walls. This targeted heating results from the exemplary shaped coil shown in FIG. 2C by increasing the magnetic coupling between the sidewall and coil central section 46 and by decreasing the magnetic coupling between the seams and end walls of can 14 and the lateral sections 44.

Figure 3:
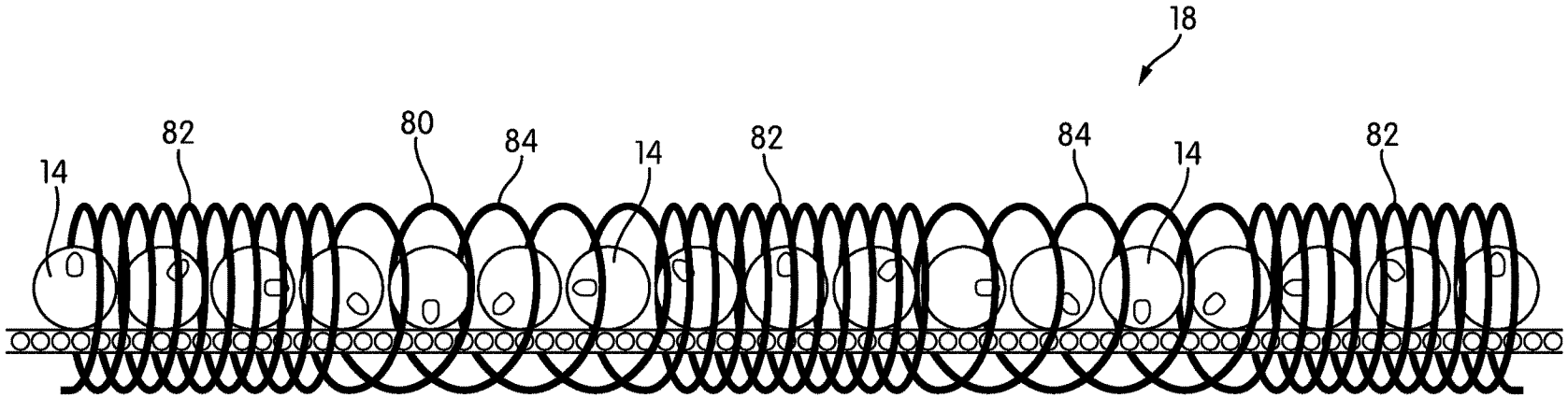
FIG. 3 is an induction heating coil according to an exemplary embodiment.

Referring to FIG. 3, heating section 18 is shown including an induction heating coil 80 in place of heating coil 34 discussed above. Heating coil 80 is similar to coil 34 in that it is configured to generate an alternating magnetic field to heat cans 14 within the lumen of the coil. As shown, heating coil 80 includes coil sections of variable coil density (i.e., the number of complete coils per unit of distance). The strength of the magnetic field generated by coil 80, and consequently, the heating induced in the material of the can, is directly related to the coil density. In the embodiment shown in FIG. 3, coil 80 includes three dense coil sections 82, and two less dense coil sections 84 located between and separating adjacent dense coil sections 82. In the embodiment shown, the coil density of coil section 84 is less than approximately 70% of the coil density of coil sections 82. In another embodiment, the coil density of coil section 84 is less than approximately 50% of the coil density of coil sections 82, and in another embodiment, the coil density of coil section 84 is less than approximately 25% of the coil density of coil sections 82.

In one embodiment, dense coil sections 82 may act to provide fast high energy input into cans 14, and less dense coil sections 84 provides a lower level of heating to allow the heat generated from the preceding dense coil section 82 to pass into contents of the container. Further this arrangement may help to prevent overheating or scorching of container contents in some applications. The number, spacing and length of dense and less dense coil sections within the coil of a particular heating section can be selected based on the needs of a particular heating application. For example, the number, spacing and length of dense and less dense coil sections within coil 80 may be selected to account for the induction properties of the cans being heated by the coil, the contents of the container being heated, the purpose of the heating (e.g., cooking the contents, sterilization, etc.), the amount of time a particular can is heated within coil 80, etc.

Figure 4:
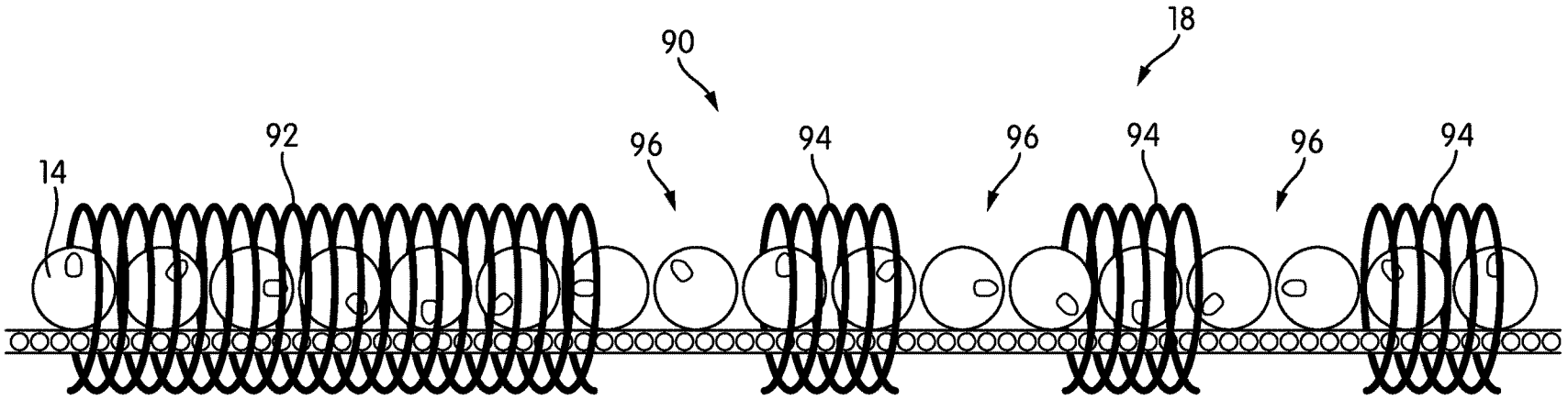
FIG. 4 is an induction heating coil according to an exemplary embodiment.

Referring to FIG. 4, heating section 18 is shown including an induction heating coil 90 in place of heating coil 34 discussed above. Heating coil 90 is similar to coil 34 in that it is configured to generate an alternating magnetic field to heat cans 14 within the lumen of the coil. As shown, heating coil 90 includes a first coil section 92 and three subsequent coil sections 94. Heating coil 90 includes three sections without coils, shown as rest spaces 96, located between the coil sections of heating coil 90. Generally, rest spaces 96 provide a section in which the metal of the can body is not actively heated by an induction coil to allow heat within the can body from the preceding coil section to be absorbed by the contents of the can. For certain heating applications, rest spaces 96 within coil 90 may be used to limit or prevent overheating and/or scorching of the contents of can 14.

In various embodiments, the length of each coil segment and/or the length of rest spaces 96 may be selected based on the needs of heating application. In the embodiment shown, first coil section 92 is more than three times the length of subsequent coil sections 94. The increased length of first coil section 92 is selected to provide most of the energy input needed to raise the contents of can 14 to the desired temperature (e.g., cooking temperature, sterilization temperature, etc.). Subsequent coil sections 94 are shorter than section 92 and have lengths selected to maintain can 14 at the desired temperature. While FIG. 4 shows a single, longer coil section 92 and three shorter coil sections 94, coil 90 may include various numbers and combinations of coil sections 92 and 94 as selected for a particular heating application.

In one embodiment, coil sections 92 is electrically connected to each of the subsequent coils 94 such that a single power supply may drive all coil sections of coil 90. In this embodiment, all coil sections of coil 90 will be operated at the same frequency and current level as all the other coil sections of coil 90. In other embodiments, coil section 92 and coil sections 94 may each be connected to dedicate or separate power sources capable of control independent of the other coil sections of coil 90. In this embodiment, heating of cans within coil 90 may be further controlled by using a different frequency and/or power within different coil sections.

Helical coils such as coils 34, 38, 80 and 90 are similar in that they are designed to receive multiple cans at one time sequentially through the lumen of the coil in the various orientations discussed above. In these embodiments, as shown in the figures, the diameter of the helical coils is slightly larger than the longitudinal axis of the cans. In such embodiments, the frequency of current used with induction coils of this type will typically be fairly high. For example, current between approximately 50 kHz and 250 kHz can be used with induction coils of this size to heat cans to the desired temperature within an acceptably fast time period. In various embodiments, heating sections of system 10 are configured to utilize current between approximately 100 kHz and 200 kHz, specifically between 125 kHz and 175 kHz, and more specifically between 140 kHz and 160 kHz. In other embodiments, the heating sections of system 10 are configured to utilize current between approximately 60 kHz and 175 kHz. In such embodiments, cans 14 remains within the induction field for a relatively short time period (e.g., less than 180 seconds, less than 120 seconds, less than 60 seconds, less than 45 seconds, less than 30 seconds, etc.) for the contents of can 14 to reach the desired sterilization temperature. In various other embodiments, cans 14 remain within the induction field for between 5 and 60 seconds, specifically between 10 and 40 seconds and more specifically between 10 and 30 seconds. Fast heating times such as these allow for high throughput heating of cans compared to conventional steam based cooking systems. In a specific embodiment, heating sections of system 10 are configured to utilize current of approximately 145 kHz (i.e., plus or minus 1 kHz), and such systems are believed to result in high heating efficiency. Specific heating times, temperatures and frequency are set based upon at least the heating properties of the contents within the container, the volume and shape of the can, the type of metal from which the can is formed, and the number of cans within the induction coil at one time.

Figure 5A:
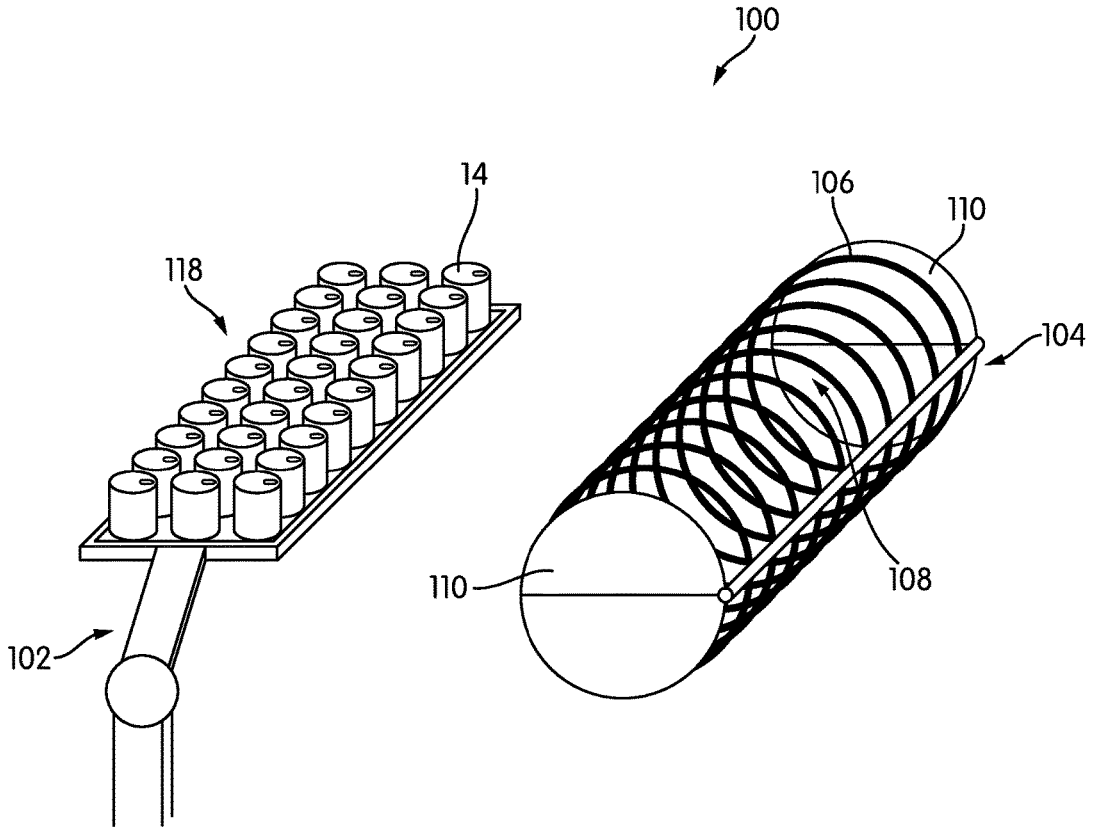
FIG. 5A is an induction heating coil and can mover according to an exemplary embodiment.
Figure 5B:
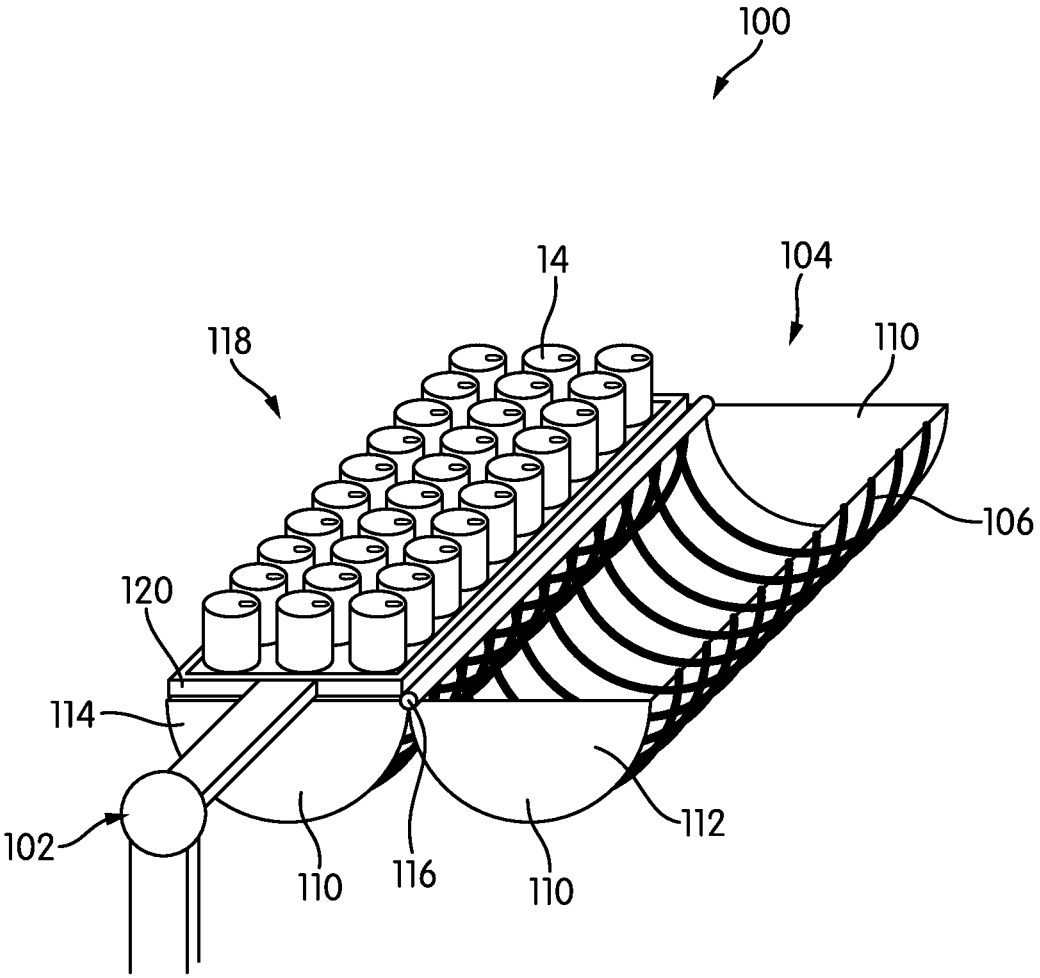
FIG. 5B is the induction heating coil and can mover of FIG. 5A in a loading configuration according to an exemplary embodiment.
Figure 5C:
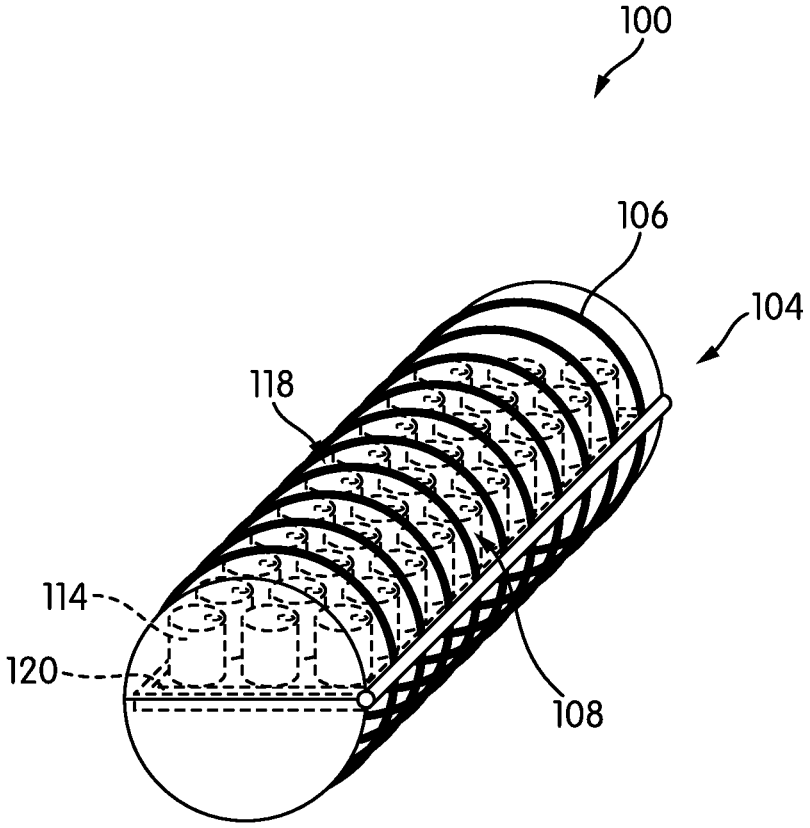
FIG. 5C is the induction heating coil of FIG. 5A during heating according to an exemplary embodiment.

Referring to FIGS. 5A-5C, a heating chamber 100 and a can mover, shown as arm 102, are shown according to an exemplary embodiment. Heating chamber 100 and arm 102 may be used in addition to or in place of heating chamber 18 and/or 20 of system 10 shown in FIG. 1. Heating chamber 100 includes an induction cage 104. Induction cage 104 includes at least one large induction coil sized to receive a large number of cans 14 (e.g., more than 100, more than 300, more than 500, more than 1000) within the central lumen of the coil and to heat the large number of cans 14 at once. As shown in FIG. 5A, induction cage 104 includes an induction coil 106 that generally defines the shape of cage 104, and defines the central lumen 108 of cage 104. Cage 104 may include end walls 110 that generally support coil 106 and may also be coupled to various support structures to support cage 104 within system 10.

As shown best in FIG. 5B, induction cage 104 is configured to open (i.e., moveable between an open position and a closed position) to allow a batch 118 of cans 14 to be placed in to the internal lumen 108 of induction cage 104. In one embodiment, cage 104 may have an upper half 112 and a lower half 114 joined at hinge 116. Hinge 116 allows the upper half 112 to pivot relative to lower half 114 from the closed position shown in FIG. 5A to open position shown in FIG. 5B. With cage 104 in the open position, arm 102 rotates bringing batch 118 into cage 104. Arm 102 then disengages from the support structure 120 supporting batch 118.

As shown in FIG. 5C, with batch 118 positioned within cage 104, upper half 112 pivots back to the closed position such that batch 118 is located within lumen 108 of induction coil 106. When cage 104 closes the portion of coil 106 in upper half 112 makes an electrical connection with the portion of the coil 106 in the lower half 114 such that coil 106 functions as a single induction coil. Similar to the coils discussed above, an alternating current is then supplied to coil 106 to generate an alternating magnetic field which in turn induces current in the electrically conductive material of the bodies and can end walls of cans 14. The induced current causes resistive heating of the material of the bodies and can end walls of cans 14 which in turn acts to heat the contents of cans 14 to the desired temperature.

As shown in FIG. 5C, support structure 120 remains within cage 104 during heating of cans 14. In one embodiment support structure 120 is made from a strong, electrically nonconductive material (e.g., Nylon, Teflon, polyimides, epoxies, HDPE, polyurethane, polycarbonate, etc.) such that the magnetic field created by coil 106 does not cause heating of support structure 120. In another embodiment, support structure 120 may engage an agitator that supplies vibration and agitation to cans 14 during heating with coil 106.

Once cans 14 have been heated to the desired temperature and for the desired length of time. Cage 104 opens moving from the position shown in FIG. 5C to the position shown in FIG. 5B. Arm 102 pivots back into the position shown in FIG. 5B and engages support structure 120. Arm 102 then pivots away from cage 104 from the position shown in FIG. 5B to the position shown in FIG. 5A to remove batch 118 from cage 104. Following removal of batch 118 from cage 104, arm 102 move batch 118 into cooling chamber 22 (shown in FIG. 1), and then the process shown in FIGS. 5A-5C may be repeated with the next batch.

In one embodiment, heating coil 106 utilizes a lower frequency current within coil 106 (as compared to other coil embodiments discussed herein). In one embodiment, heating coil 106 utilizes a 60 Hz current to generate the magnetic field to heat cans 14, and in another embodiment, heating coil 106 utilizes a 50 Hz current to generate the magnetic field to heat cans 14. In some embodiments, heating coil 106 utilizes a current frequency that is a multiple of either 60 Hz or 50 Hz. Thus, in various embodiments, heating coil 106 utilizes at least one of the following current frequencies, 100 Hz, 120 Hz, 150 Hz, 180 Hz, 200 Hz, and 240 Hz. Use of a lower frequency current within a heating induction coil tends to increase the amount of time required to heat a can to given temperature as compared to a high frequency induction coil current. However, in the embodiment shown, use of a can mover, such as arm 102, that moves a large number of cans 14 into coil 106 at once, compensates for the increased heating time resulting from the lower induction coil current frequency. Thus, the embodiment shown in FIGS. 5A-5C allows for use of lower induction coil current frequency while maintaining a suitably high can processing rate (i.e., number of cans heated per time period). In some embodiments, use of lower frequency heating (e.g., the 50 Hz or 60 Hz systems discussed herein) are used to heat cans containing food in which conduction is the primary mode of heat transfer within the can, and use of the higher frequency heating (e.g., the 125 kHz to 175 kHz systems discussed herein) are used to heat cans containing food in which convection is the primary mode of heat transfer within the can.

Figure 6A:
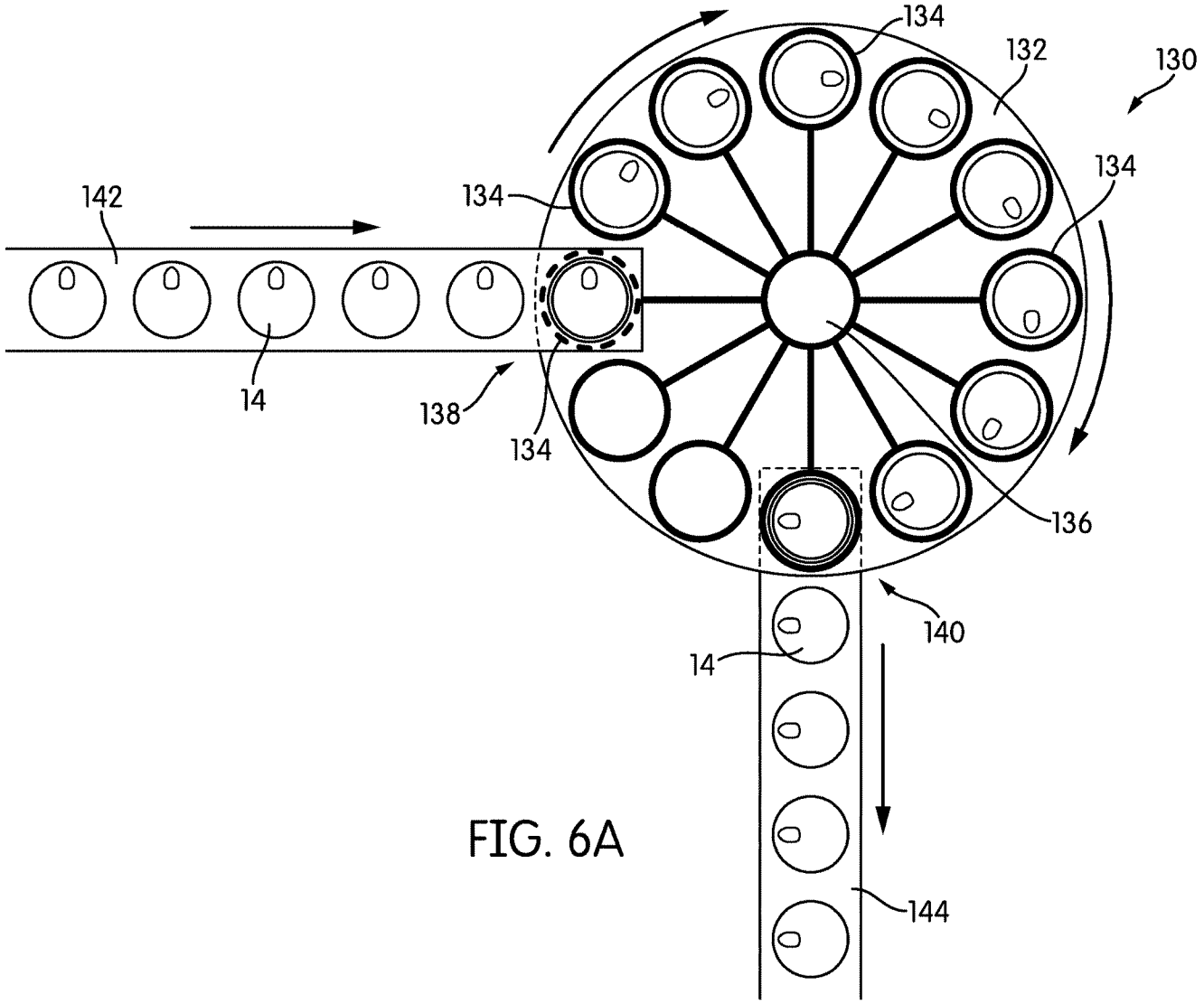
FIG. 6A is an induction heating coil and can mover, shown as a horizontal rotating turret, according to an exemplary embodiment.

Referring to FIG. 6A, a heating chamber 130 and a can mover, shown as turret 132, are shown according to an exemplary embodiment. Heating chamber 130 and turret 132 may be used in addition to or in place of heating chamber 18 and/or 20 of system 10 shown in FIG. 1. Turret 132 includes a plurality of single can sized induction coils 134. Similar to the coils discussed above, an alternating current at one or more different frequencies is supplied to each coil 134 to generate an alternating magnetic field which in turn induces current in the material of the bodies and/or end walls of cans 14. The induced current causes resistive heating of the material of the bodies and/or end walls of cans 14 which in turn acts to heat the contents of cans 14 to the desired temperature. As explained in more detail below, because coil 134 contains and heats a single can within a single coil 134, the magnetic field generated by coil 134 may be altered to heat can 14 based on particular characteristics of the can (e.g., the size, shape, contents of the can).

In general, a conveyor 142 delivers cans 14 to the input position 138 of turret 132. A can 14 is received within an empty coil 134 positioned to receive the can from conveyor 142 (the left-most coil 134 shown in FIG. 6A). In the arrangement of FIG. 6A, turret 132 then rotates in the clockwise direction around axle 136, and while turret 132 is rotating, coil 134 is energized heating can 14. When turret 132 has rotated to the output position 140 (shown at the 6 o'clock position in FIG. 6A), coil 134 is de-energized and heated can 14 is deposited onto a conveyor 144 which then moves can 14 to cooling chamber 22 shown in FIG. 1.

In one embodiment, as shown in FIG. 6A, conveyor 142 is positioned above turret 132 so that can 14 is permitted to drop into coil 134 when can 14 is positioned above the empty coil in the input position 138 of turret 132. Conveyor 144 is located below turret 132 such that can 14 is allowed to drop out of coil 134 onto conveyor 144 after turret 132 has rotated to output position 140. In another embodiment, turret 132, conveyor 142 and conveyor 144 are at the same height such that cans 14 move in and out of coils 134 without dropping. In one such embodiment, coils 134 are configured to be moved upward allowing can 14 to assume the proper position on turret 132, and once can 14 is in place on turret 132, coil 134 is moved downward over can 14 such that can 14 is located within the internal lumen of coil 134. In one embodiment, turret 132 rotates at a speed such that the time it takes turret 132 to move between input position 138 and output position 140 matches the desired heating time of can 14. Matching rotational time between input and output positions acts to maximize the processing throughput of heating section 130.

Figure 6B:
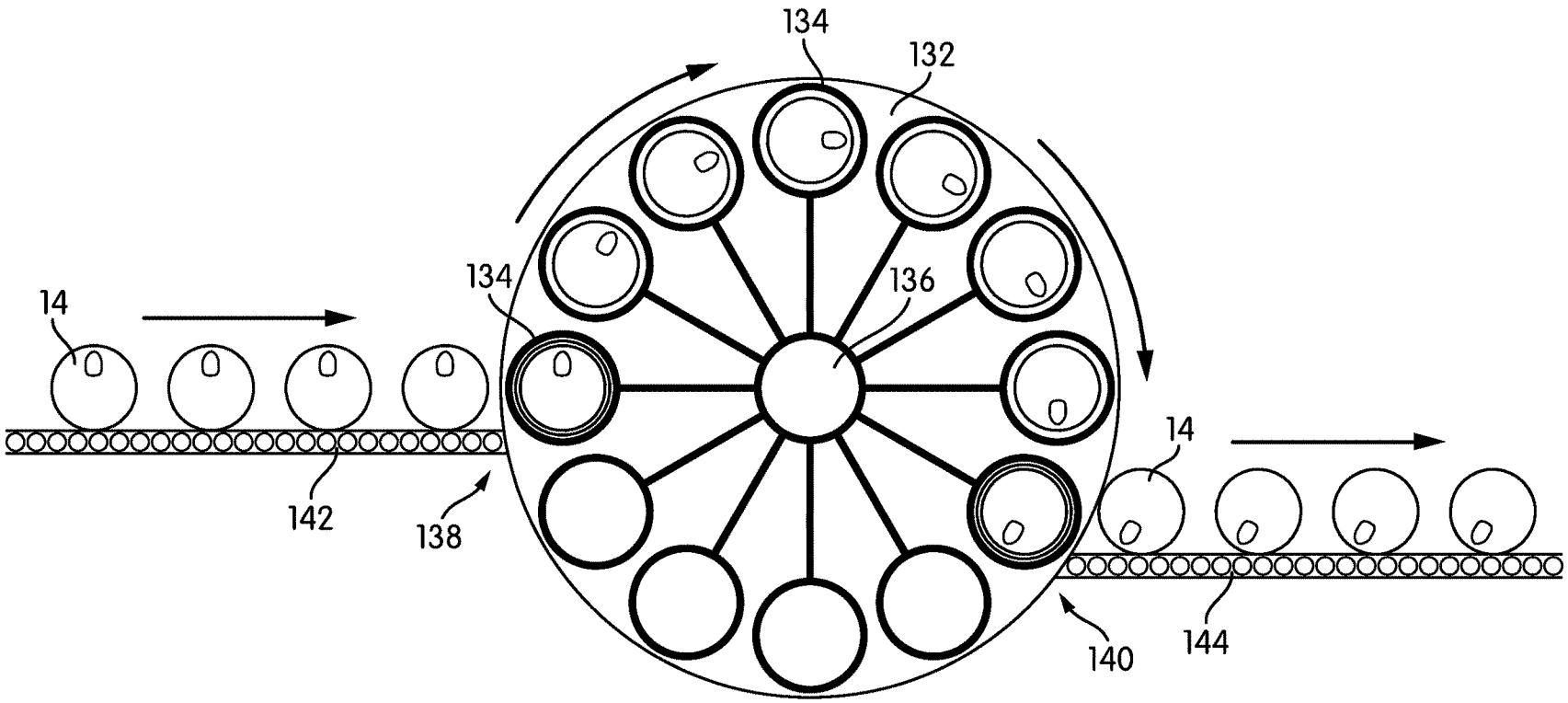
FIG. 6B is an induction heating coil and can mover, shown as a vertical rotating turret, according to an exemplary embodiment.

In the embodiment shown in FIG. 6A, turret 132 is a substantially horizontal turret (i.e., a turret that rotates in a substantially horizontal plane about a generally vertical axis). In another embodiment, shown in FIG. 6B, turret 132 may be a substantially vertical turret (i.e., a turret that rotates in a substantially vertical plane about a generally horizontal axis). Thus, in the embodiment shown in FIG. 6B, cans 14 are generally horizontal (i.e., the longitudinal axis of each can is substantially horizontal) as the cans move along conveyors 142 and 144 and within the heating coils 134 of vertical turret 132.

As noted above, system 10 is configured to resist the outwardly directed force created as the contents within the hermetically sealed cans are heated. As an example, as discussed above, the different heating sections are configured to be maintained at a pressure higher than ambient air pressure as a means of counteracting the outward force exerted on the end walls and sidewall of cans 14 as the contents of cans 14 are heated. However, in other embodiments, other mechanisms of counteracting the outward force exerted on the end walls and sidewall of cans 14 as the contents of cans 14 are heated are used. In various embodiments, can 14 itself may be designed to compensate for the increased internal pressure that occurs as the contents of the can are heated. In one such embodiment, can 14 may include one or more end walls configured to expand or deform outwardly without bursting to relieve the internal pressure as the contents of can 14 are heated.

Figure 7:
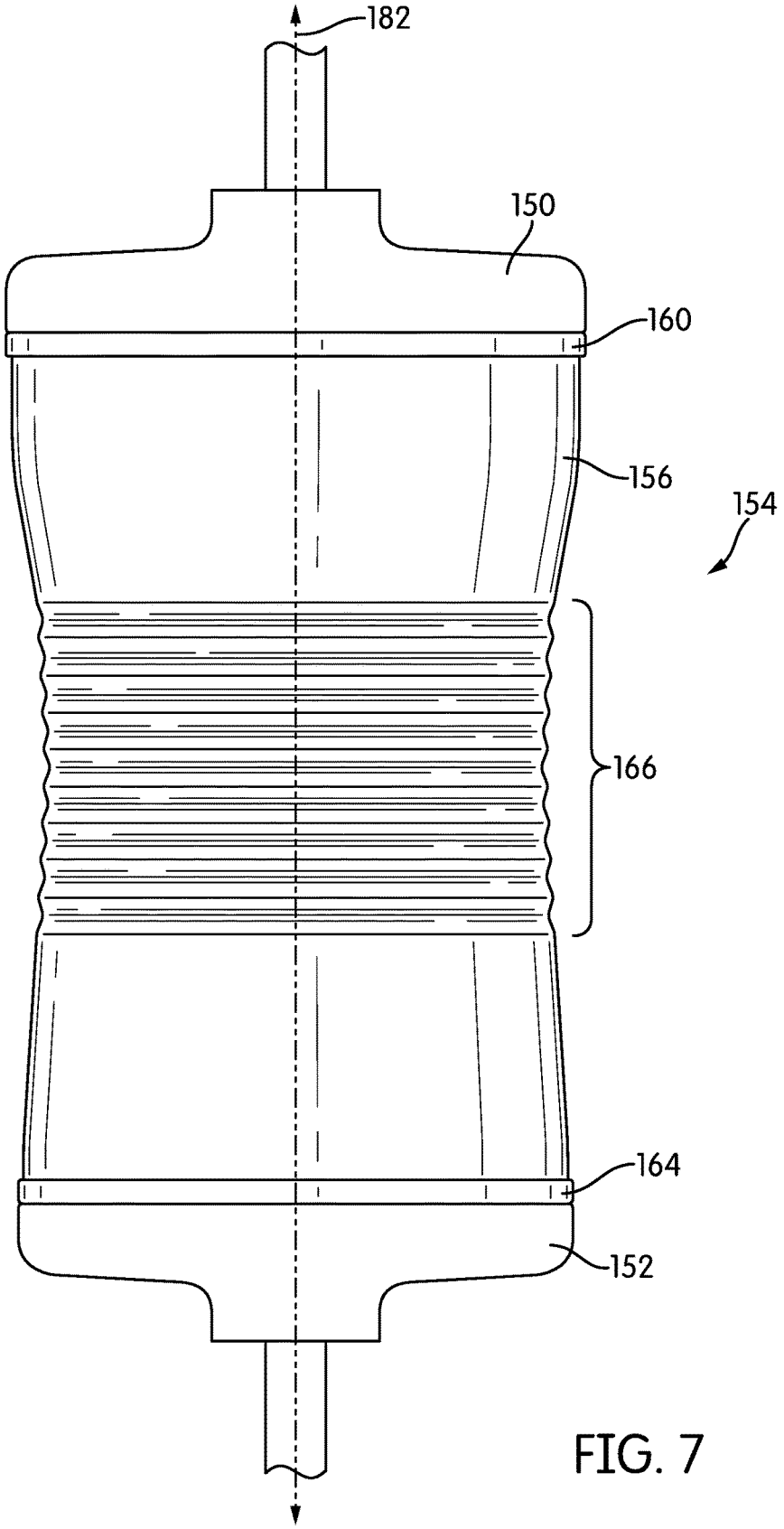
FIG. 7 is a physical support device for use within an induction heating coil according to an exemplary embodiment.
Figure 8:
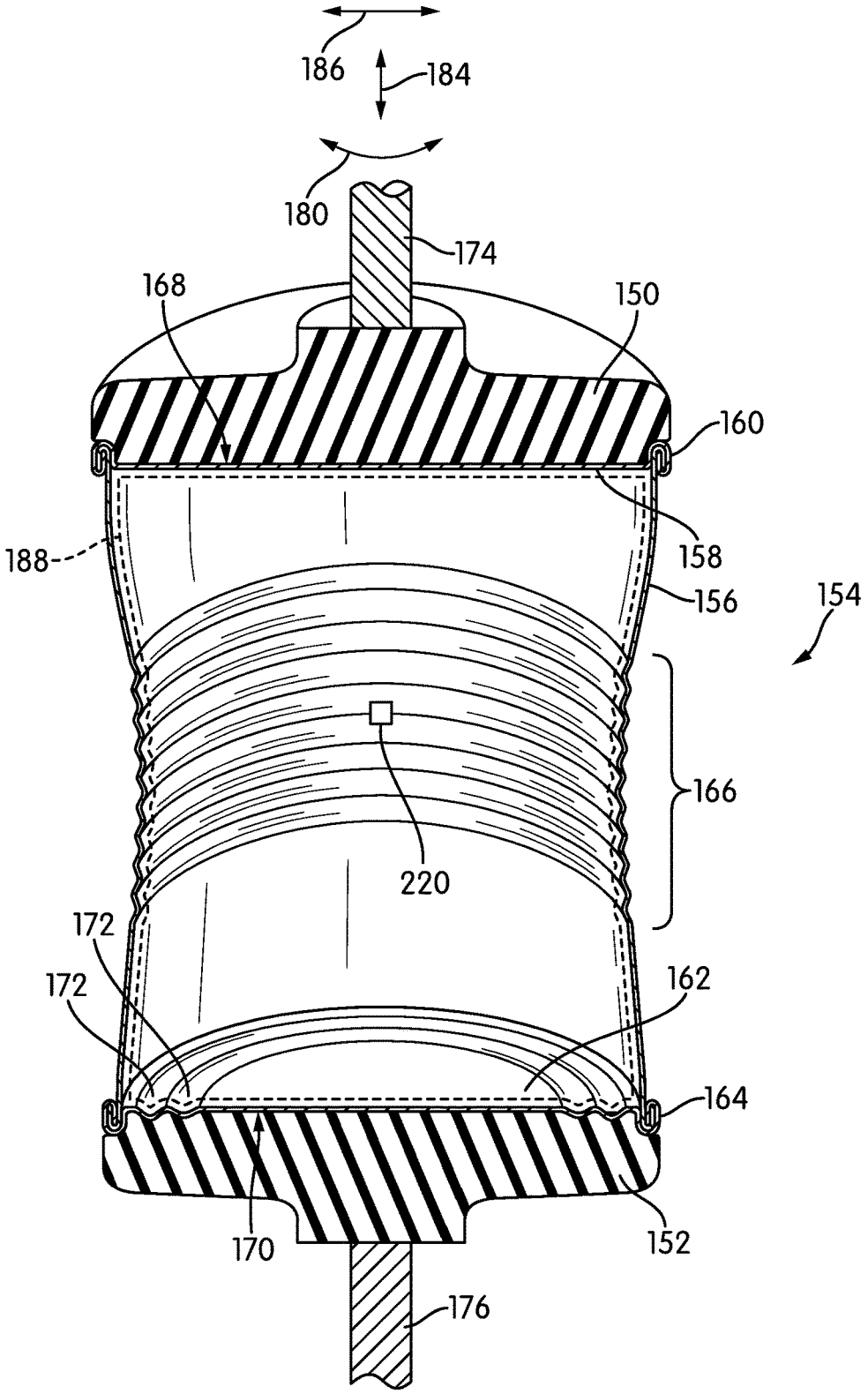
FIG. 8 is a sectional view of the physical support device of FIG. 7 according to an exemplary embodiment.

In other embodiments, shown for example in FIGS. 7 and 8, system 10 may include physical support structures, shown as upper support 150 and lower support 152, that physically engage the upper and lower can end walls and resist outward deformation as the can is heated within one of the induction coil heaters discussed herein. FIGS. 7 and 8 shows a can 154 engaged by an upper support and a lower support as the can would be engaged within an induction heating coil, but for simplicity of illustration the induction coil is not shown in FIGS. 7 and 8. Can 154 is a specific example of can 14 shown generally in the preceding figures. It should be understood that the physical support structure embodiments discussed herein may be used in conjunction with any of the induction coil embodiments and heating section embodiments discussed here. Further, while FIGS. 7 and 8 depict a particular non-cylindrical shaped can 154, the heating section, induction coils and physical support structures discussed herein can be used with various sized cylindrical cans, such as cans 14, or a wide variety of non-cylindrical shaped cans, such as can 154.

Can 154 has a non-cylindrical sidewall 156 that has a diameter that varies at different longitudinal positions along the sidewall. Specifically, sidewall 156 has its smallest diameter at or near the vertical center point of sidewall 156. Sidewall 156 is coupled to an upper end wall 158 via an upper double seam 160 and is coupled to a lower end wall 162 via a lower double seam 164. Can 154 includes a beaded sidewall section 166 generally located through a central area of sidewall 156. Beaded sidewall section 166 acts to strengthen sidewall 156 against radially directed forces that may be experienced by sidewall 156 during different stages of can processing (e.g., vacuum, inward forces generated at filling and sealing and/or following cooling of hot-fill cans, etc.).

As shown best in FIG. 8, upper support 150 engages upper double seam 160 and upper end wall 158. Lower support 152 engages lower double seam 164 and lower end wall 162. In the embodiment shown, the lower surface 168 of upper support 150 is shaped to match the shape of upper double seam 160 and upper end wall 158, and the upper surface 170 of lower support 152 is shaped to match the shape of lower double seam 164 and lower end wall 162. In particular, in the embodiment, shown lower end wall 162 includes two end wall beads 172, and upper surface 170 of lower support 152 is shaped to match the shape of end wall beads 172. While, upper end wall 158 is shown without end wall beads in the exemplary embodiment shown, upper wall 158 may have one or more end wall beads, and in this embodiment, lower surface 168 of upper support 150 is shaped to match the shape of the end wall beads similar to lower support 152 shown in FIG. 8.

The close engagement between upper support 150 and upper end wall 158 and between lower support 152 and lower end wall 162 supports the end walls during heating within the induction coils discussed herein. Specifically, upper support 150 and lower support 152 exert an inwardly directed force on the end walls that resists the outward expansion of the end walls as the pressure within the can increases during heating. In the embodiment shown, a shaft 174 engages upper support 150, and a shaft 176 engages lower support 152. Shafts 174 and 176 are supported within system 10 such that upper support 150 and lower support 152 are capable of resisting the outward expansion of end walls 158 and 162 during heating. In this manner, upper support 150 and lower support 152 act to prevent failure or rupture of end walls during heating. Further, in some embodiments, physical support of the end walls of the can during heating eliminates the need for the heating chamber to pressurized. Further, because the induction heating coils discussed herein heat cans independent of pressure within the heating chamber (in contrast to conventional steam based can heating systems) use of induction coil based heating sections combined with the can end physical support structures may eliminate the need for the heating chambers to be pressurized.

Upper support 150 and lower support 152 are typically present within the induction coil during heating. Accordingly, in various embodiments, upper support 150 and lower support 152 are made from an electrically non-conductive material such that the supports do not interact with the magnetic field generated by the induction heating coils. In addition, upper support 150 and lower support 152 are made from a material with low heat conduction properties such that the support structures do not absorb a substantial amount of heat from the can during heating. In various embodiments, upper support 150 and lower support 152 are made from a strong electrically non-eclectically conductive, heat resistant material, for example, Nylon, Teflon, polyimides, epoxies, HDPE, polyurethane, polycarbonate, etc. Heat resistance of the material of upper support 150 and lower support 152 resists or limits melting and/or deformation that may otherwise be caused through the contact with the heated metal of cans 14.

In various embodiments, upper support 150 and lower support 152 are configured to provide the rotational motion and/or agitation motion to can 154, as discussed above. As shown in FIG. 8, upper support 150 and lower support 152 are configured to rotate in the direction shown by arrow 180. When upper support 150 and lower support 152 rotate in the direction of arrow 180, can 154 is rotated about can longitudinal axis 182 (shown in FIG. 7). Upper support 150 and lower support 152 are also configured to impart agitation in the vertical direction shown by arrow 184 and/or in the horizontal direction as shown by arrow 186. In various embodiments, upper support 150 and lower support 152 are configured to impart only rotational motion, to impart only agitation, or to impart both agitation and rotation. As discussed above, rotation and agitation help to conduct heat from the body of the can (e.g., sidewall 156, end walls 158 and 162) into and throughout contents 188 (shown schematically in FIG. 8) of can 154.

In embodiments including agitation and/or rotational movement, upper support 150 and lower support 152 are coupled to one or more actuators (e.g., electric motors) that provide rotational and/or agitation motion to the supports. In one such embodiment, the actuators are coupled to upper support 150 and lower support 152 via shafts 174 and 176, respectively. In various embodiments, upper support 150 and lower support 152 are configured to rotate can 154 about the can's longitudinal axis 182 at a speed greater than 200 rpm, specifically between 200 rpm and 600 rpm, and more specifically between 300 rpm and 500 rpm. In more specific embodiments, upper support 150 and lower support 152 are configured to rotate cans about the can's longitudinal axis 182 at a speed between 350 rpm and 450 rpm and more specifically at about 400 rpm. In other embodiments, upper support 150 and lower support 152 are configured to rotate can 154 about the can's longitudinal axis 182 at a speed greater than 50 rpm, between 50 rpm and 600 rpm, and more specifically between 50 rpm and 300 rpm. In more specific embodiments, upper support 150 and lower support 152 are configured to rotate can 154 about the can's longitudinal axis 182 at a speed between 50 rpm and 200 rpm, and more specifically between about 100 rpm and 200 rpm. In another embodiment, upper support 150 and lower support 152 are configured to rotate can 154 about the can's longitudinal axis 182 at a speed between 80 rpm and 600 rpm.

Figure 9A:
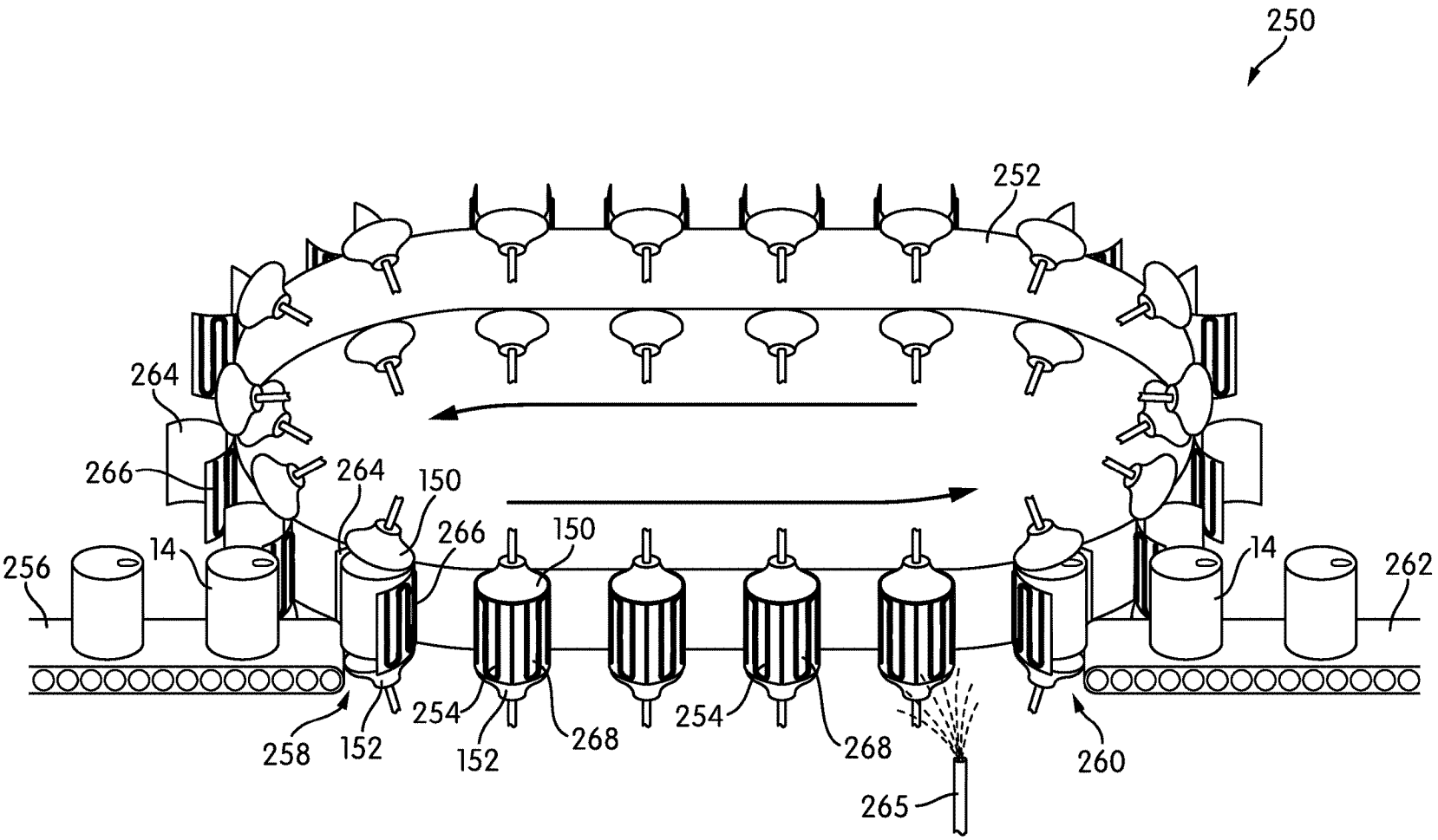
FIG. 9A is an induction heating coil and can mover according to an exemplary embodiment.

Referring to FIG. 9A, a heating chamber 250 and a can mover, shown as induction belt 252, are shown according to an exemplary embodiment. Heating chamber 250 may be used in addition to or in place of heating chamber 18 and/or chamber 20 of system 10 shown in FIG. 1. Induction belt 252 includes a plurality of single can sized induction coils 254. Induction coils 254 extend outwardly from a radially outward facing surface of induction belt 252. Similar to the coils discussed above, an alternating current at one or more different frequencies is supplied to each coil 254 to generate an alternating magnetic field which in turn induces current in the material of the bodies and/or end walls of cans 14. The induced current causes resistive heating of the material of the bodies and/or end walls of cans 14 which in turn acts to heat the contents of cans 14 to the desired temperature.

In general, a conveyor 256 delivers cans 14 to the input position 258 of induction belt 252. A can 14 is received within an empty coil 254 positioned to receive the can from conveyor 256 (the left-most coil 254 shown in FIG. 9A). In the arrangement of FIG. 9A, induction belt 252 then rotates in the counter-clockwise direction, and while induction belt 252 is rotating, coil 254 is energized, heating can 14. When induction belt 252 has rotated to the output position 260, coil 254 is de-energized, and heated can 14 is deposited onto a conveyor 262 which then moves can 14 to cooling chamber 22 shown in FIG. 1.

In the embodiment shown in FIG. 9A, each induction coil 254 is a split coil having a first half 264 and a second half 266. At can receiving position 258, first half 264 and second half 266 open by moving away from each other creating an opening through which can 14 is received. Once can 14 is received within coils 254, first half 264 and second half 266 are moved toward each other such that coil 254 is moved to a closed position capturing can 14 within lumen of the coil 254. In another embodiment, first half 264 and second half 266 are positioned relative to each other such that a gap is located between the two halves of sufficient size that can 14 can pass into the lumen of induction coil 254. In another embodiment, coils 254 are cylindrical, helical coils similar to those shown in FIGS. 6A and 6B, and cans 14 are moved into coils 254 by dropping from conveyor 256 into the coil through an open end of the coil.

As shown in FIG. 9A, the outer surface of induction belt 252 is a substantially vertically disposed surface, and induction belt 252 rotates in a substantially horizontal plane. In this orientation, cans 14 are positioned within coils 254 such that they are in the substantially vertical position shown in FIG. 9A during heating. In some embodiments, heating coils 254 may be oriented such that the longitudinal axis of each can 14 is perpendicular to the longitudinal axis of the coil as discussed above. In other embodiments, heating coils 254 may be oriented such that the longitudinal axis of each can 14 is parallel to the axis of the coils. In another embodiment, cans are positioned within coils 254 such that the cans 14 are in a substantially horizontal position (similar to FIG. 1) during heating. Induction belt 252 rotates at speed selected such that the appropriate or desired amount of heating has occurred as the induction belt 252 moves can 14 from input position 258 to output position 260.

Heating chamber 250 is equipped with a plurality of upper supports 150 and a plurality of lower supports 152. Upper supports 150 and lower supports 152 provide the functionalities (e.g., resistance against internal pressure, and rotation and/or agitation) discussed above regarding FIGS. 7 and 8. In heating chamber 250, supports 150 and supports 152 are configured to move together to engage the end walls of cans 14 at can receiving position 258. In the embodiment shown, supports 150 and 152 are configured to pivot inwardly (inwardly relative to can 14) to engage can 14. In another embodiment, supports 150 and 152 are configured to move axially (without pivoting) relative to can 14 to engage the end walls of can 14. In one embodiment, heating chamber 250 includes upper and lower tracks (similar to the support tracks 310 and 312 shown in FIGS. 10 and 11 discussed below) that guide supports 150 and 152 and move supports 150 and 152 in synch with the rotation of induction belt 252. In one such embodiment, the upper and lower tracks are shaped to bring supports 150 and 152 into engagement with the end walls of can 14. In one such embodiment, the tracks converge such that supports 150 and 152 are brought together in the axial direction to engage the end walls of cans 14.

Heating chamber 250 includes a cooling device, shown as sprayer 265. Sprayer 265 is configured to spray can 14 with a cooling fluid as the can is finished heating and is moved to output position 260. Sprayer 265 may be configured to spray air, water, or any other cooling fluid to cool can 14 prior to exit from heating chamber 250. Spraying cans 14 with a fluid, such as water, prior to the can entering cooling chamber 22 facilitates cooling of cans 14 by providing evaporative cooling to cans 14.

Figure 9B:
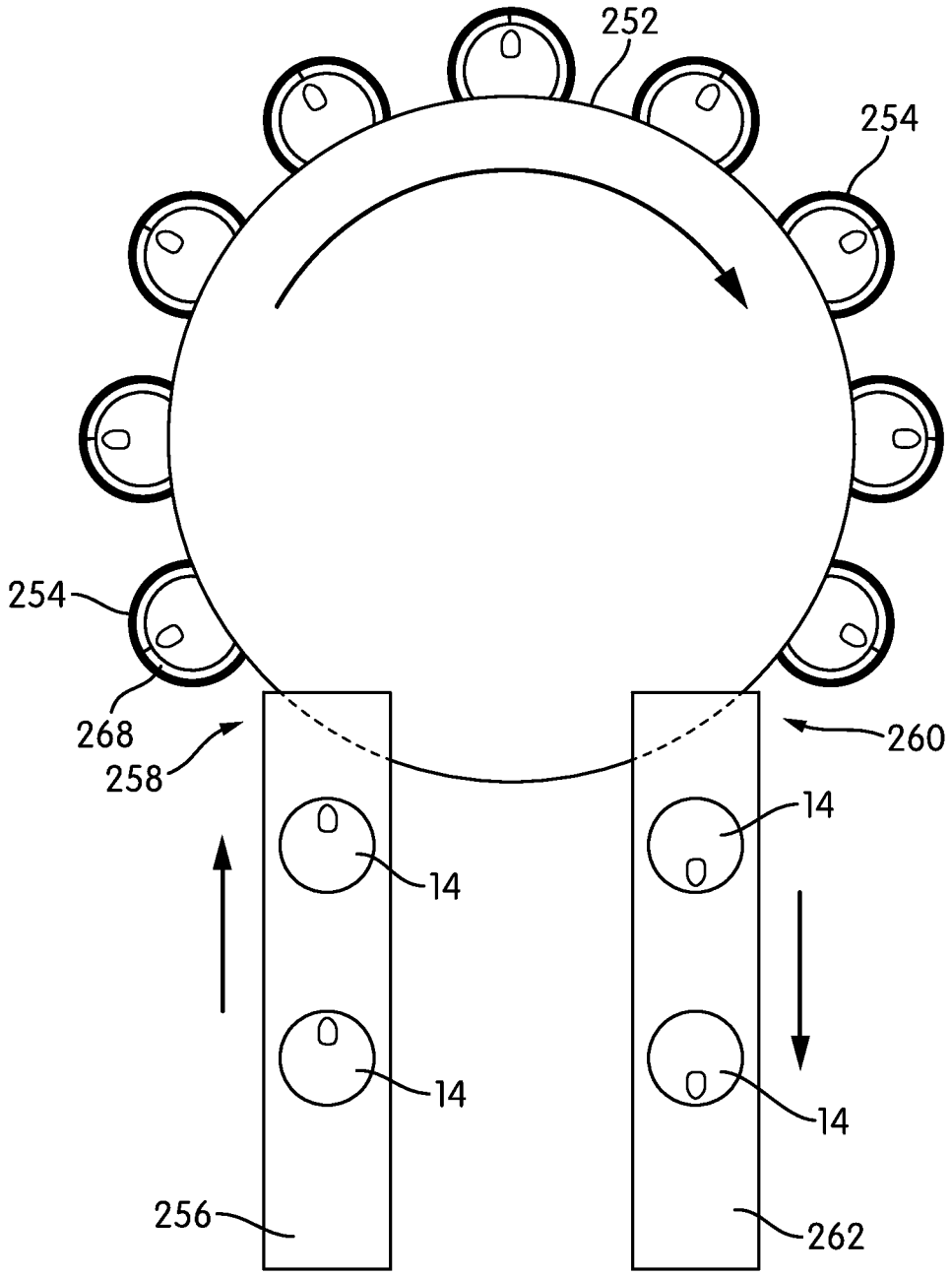
FIG. 9B is an induction heating coil and can mover according to an exemplary embodiment.

FIG. 9B shows another spatial arrangement of heating chamber 250. In this embodiment, belt 252 rotates counter-clockwise from the intake position 258 to output position 260. In this embodiment, cans 14 are heated within induction coils 254 for a larger percentage of the rotational time of belt 252 as compared to the arrangement shown in FIG. 9A. Further, conveyors 256 and 262 run in opposite but parallel directions, which may save space is the processing facility.

In various embodiments, the heating systems discussed herein are configured to provide physical support or restraint to sidewalls of cans 14 to resist outward deformation as the can is heated within one of the induction coil heaters. In particular such sidewall support maybe desirable in an embodiment in which the induction heating system is being used to heat a can with a non-cylindrical sidewall (e.g., can 154 shown in FIG. 8). Referring to FIG. 9B, for heating coils 254 include a buttress or support layer 268. Support 268 is shaped to engage the outer sidewall surface of cans 14. In one embodiment, the inner surface of support 268 is contoured to match the non-cylindrical shape of sidewall. In addition to resisting deformation, support layer 268 also acts to minimize the air gap between coils 254 and can 14 and also provides the gripping that allows can 14 to be moved along with belt 252. Similar to supports 150 and 152, support layer 268 is formed from strong electrically non-eclectically conductive, heat resistant material, for example, Nylon, Teflon, polyimides, epoxies, HDPE, polyurethane, polycarbonate, etc.

Figure 10A:
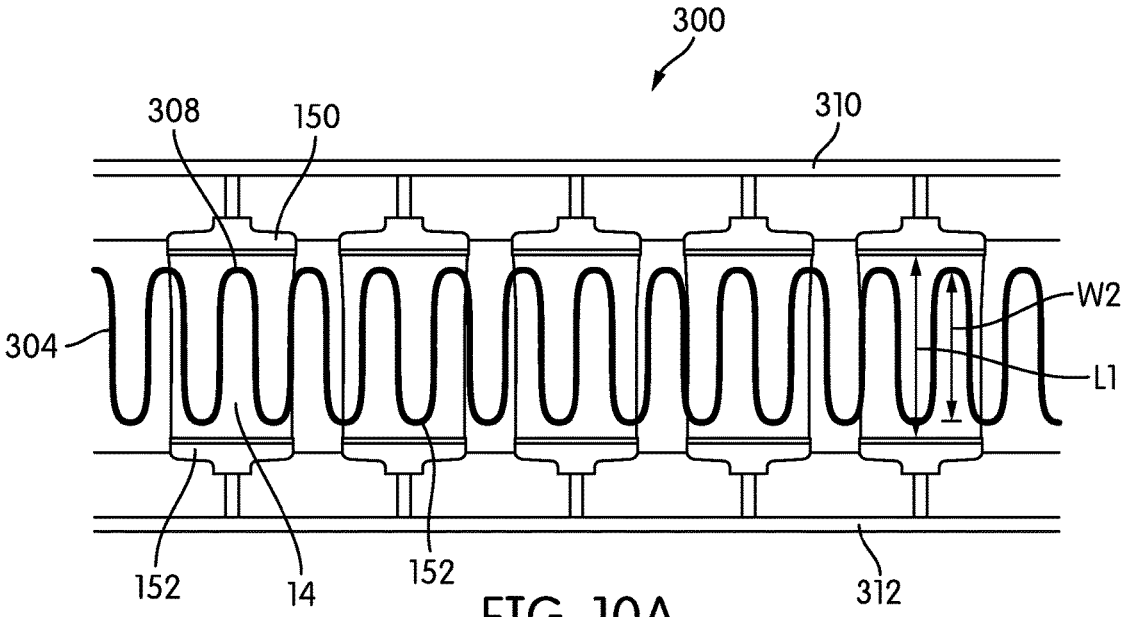
FIG. 10A is a top view of an induction heating coil and can mover according to an exemplary embodiment.
Figure 11A:
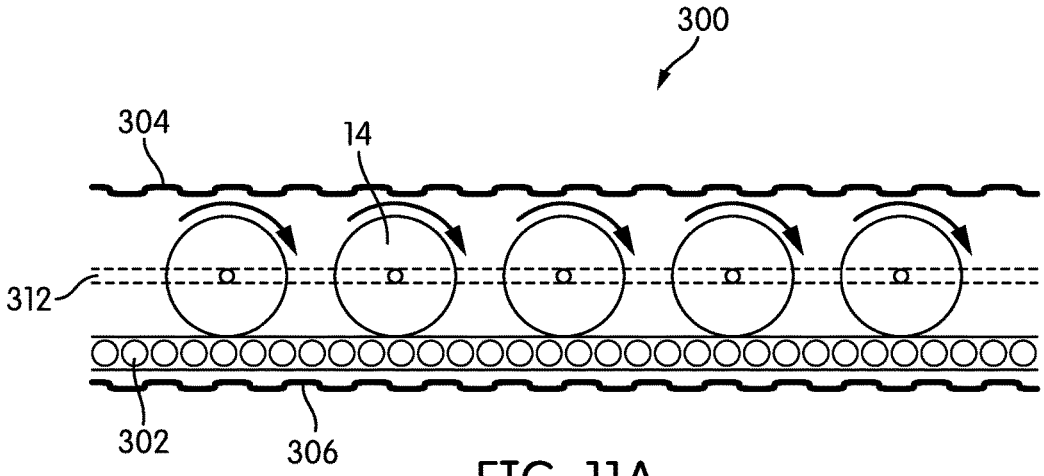
FIG. 11A is a side view of the induction heating coil and can mover of FIG. 10A according to an exemplary embodiment.

Referring to FIG. 10A and FIG. 11A, a heating chamber 300 and a can mover, shown as conveyor belt 302, are shown according to an exemplary embodiment. Heating chamber 300 may be used in addition to or in place of heating chamber 18 and/or chamber 20 of system 10 shown in FIG. 1. Heating chamber 300 includes an upper induction coil 304 and a lower induction coil 306. Similar to the coils discussed above, an alternating current at one or more different frequencies is supplied to coils 304 and 306 to generate an alternating magnetic field which in turn induces current in the material of the sidewall of cans 14. The induced current causes resistive heating of the material of the sidewall of cans 14 which in turn acts to heat the contents of cans 14 to the desired temperature.

In contrast to the helical coil shown in FIG. 1, coils 304 and 306 are generally planar coils having longitudinal axes substantially parallel to the rolling direction of cans 14. As shown upper coil 304 is located above cans 14, and lower coil 306 is located below both cans 14 and conveyor 302. Cans 14 are disposed substantially horizontally between coils 304 and 306. Coils 304 and 306 each include a plurality of U-shaped bends 308 that define the lateral edges of coils 304 and 306. In this embodiment the lateral dimension or width, W1, of coils 304 and 306 is less than the axial length, L1, of the sidewall of cans 14 between the upper and lower seams. This arrangement creates a magnetic field that interacts primarily with the sidewalls of cans 14 while minimizing or eliminating magnetic field interaction with the end walls and double seams of cans 14.

Heating chamber 300 includes support structures 150 and 152 engaged with the end walls of each can 14 and provide the functionalities (e.g., rotation, agitation, etc.) discussed above. Heating chamber 300 includes a pair of tracks or rails, including a first track 310 and second track 312. Tracks 310 and 312 run substantially parallel to conveyor 302, and support structures 150 and 152 extend inward towards cans 14 from tracks 310 and 312, respectively.

Figure 10B:
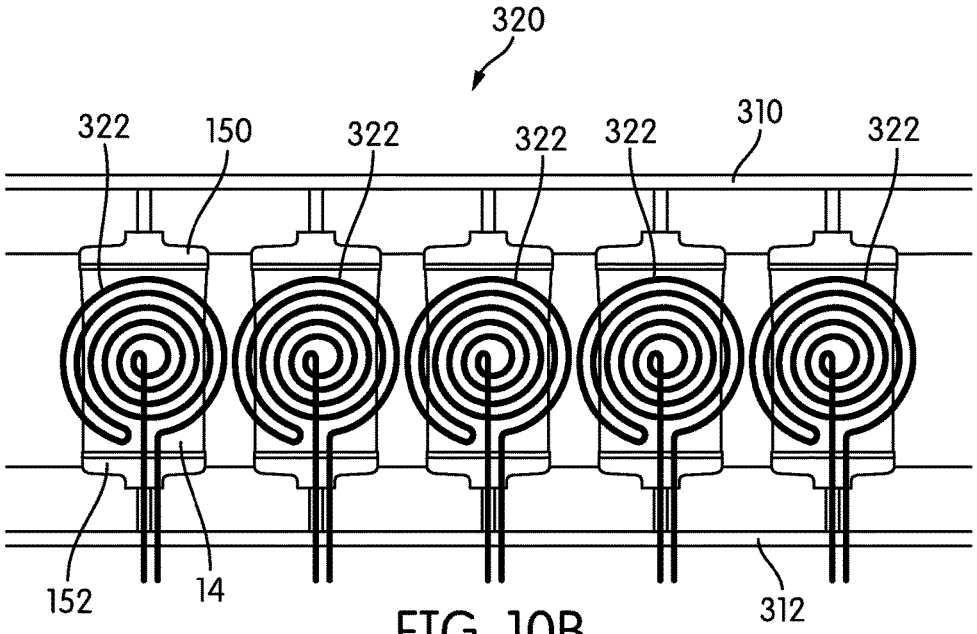
FIG. 10B is a top view of an induction heating coil and can mover according to an exemplary embodiment.

As noted above the induction heating systems herein may include heating coils having a variety of geometries. Referring to FIG. 10B, a heating system 320 is shown including an array of individually controllable induction coils 322. Heating chamber 320 may be used in addition to or in place of heating chamber 18 and/or chamber 20 of system 10 shown in FIG. 1. Heating system 320 is substantially the same as heating system 300 discussed above except for the arrangement and geometry of the induction coils. In the embodiment shown, coils 322 are planar (or pancake) induction coils. Coils 322 may be located above and below cans 14. Similar to the coils discussed above, an alternating current at one or more different frequencies is supplied to coils 322 to generate an alternating magnetic field which in turn induces current in the material of the sidewall of cans 14. The induced current causes resistive heating of the material of the sidewall of cans 14 which in turn acts to heat the contents of cans 14 to the desired temperature.

Figure 11B:
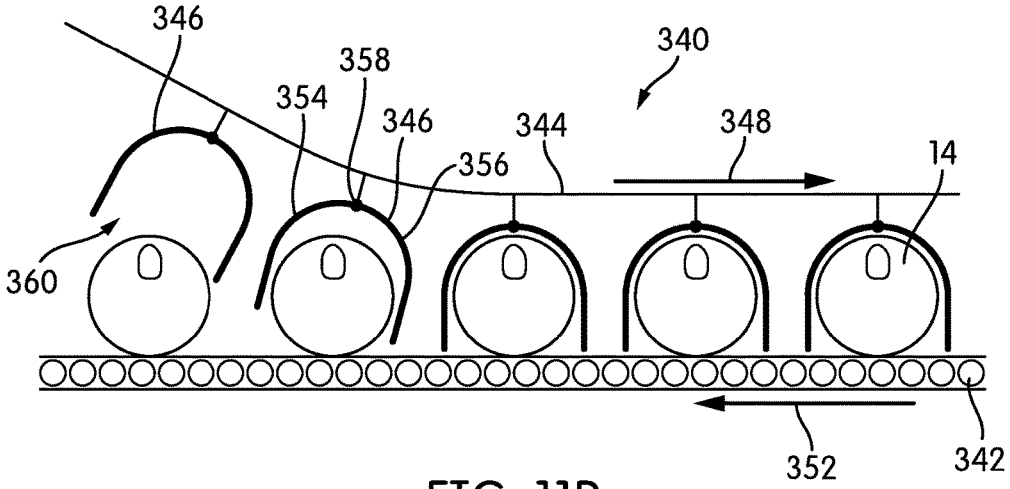
FIG. 11B is a side view of the induction heating coil and can mover according to an exemplary embodiment.

Referring to FIG. 11B, in various embodiments, the induction heating systems discussed herein, for example heating system 340, include coils which are adjustable to accommodate cans of different sizes (e.g., different diameters, different axial lengths, etc.). Heating system 340 includes a conveyor 342, a track 344 and a plurality of induction coil units 346 coupled to track 344. Coil units 346 move along track 344 in the direction shown by arrow 348 to surround cans 14 delivered to the can receiving position 348 of conveyor 342. Cans 14 are moved in the direction shown by arrow 348 by the movement of coil units 346. Conveyor 342 moves in the opposite direction shown by arrow 352. Cans 14 are permitted to roll freely along the upper surface of conveyor 342, and in this arrangement, the opposing motion of coil units 346 and conveyor 342 causes rotational motion of cans 14 about the longitudinal axis of the cans. In one embodiment, lateral tracks run parallel to conveyor 342 and support end wall supports 150 and 152 to engage the end walls of cans 14 within heat system 340.

Each coil unit 346 includes a first sidewall unit 354 and second sidewall unit 356 moveably coupled together at a joint 358. Joint 358 allows sidewall units 354 and 356 to move inward and outward to contract and expand the coil lumen 360 of each coil 346. In this manner coil units 346 can change size to accommodate cans of different diameters. In one embodiment, the size (e.g., the relative positioning between sidewall units 354 and 356) of coil units 346 can be adjusted manually. In another embodiment, the size (e.g., the relative positioning between sidewall units 354 and 356) of coil units 346 can be adjusted mechanically, for example through a servo controlled by control system 200 discussed herein.

In various embodiments, system 10 may include one or more control systems configured to control operation of system 10 to provide for effective and/or efficient heating of cans 14. In one embodiment, the control system is configured to control and alter the operation of the can mover (e.g., conveyor 12, arm 102, turret 132, conveyors 142 and 144, induction belt 252, and conveyor 302) and/or to control operation of the induction coil (e.g., alter frequency of current in coil, alter level of current in coil, turn coil on or off, etc.) to heat cans 14 according to a particular cooking and/or sterilization protocol. The control system may also be configured to control the rotation and/or agitation provided to cans 14 within the various heating system embodiments discussed herein, for example via support structures 150 and 152.

Figure 12:
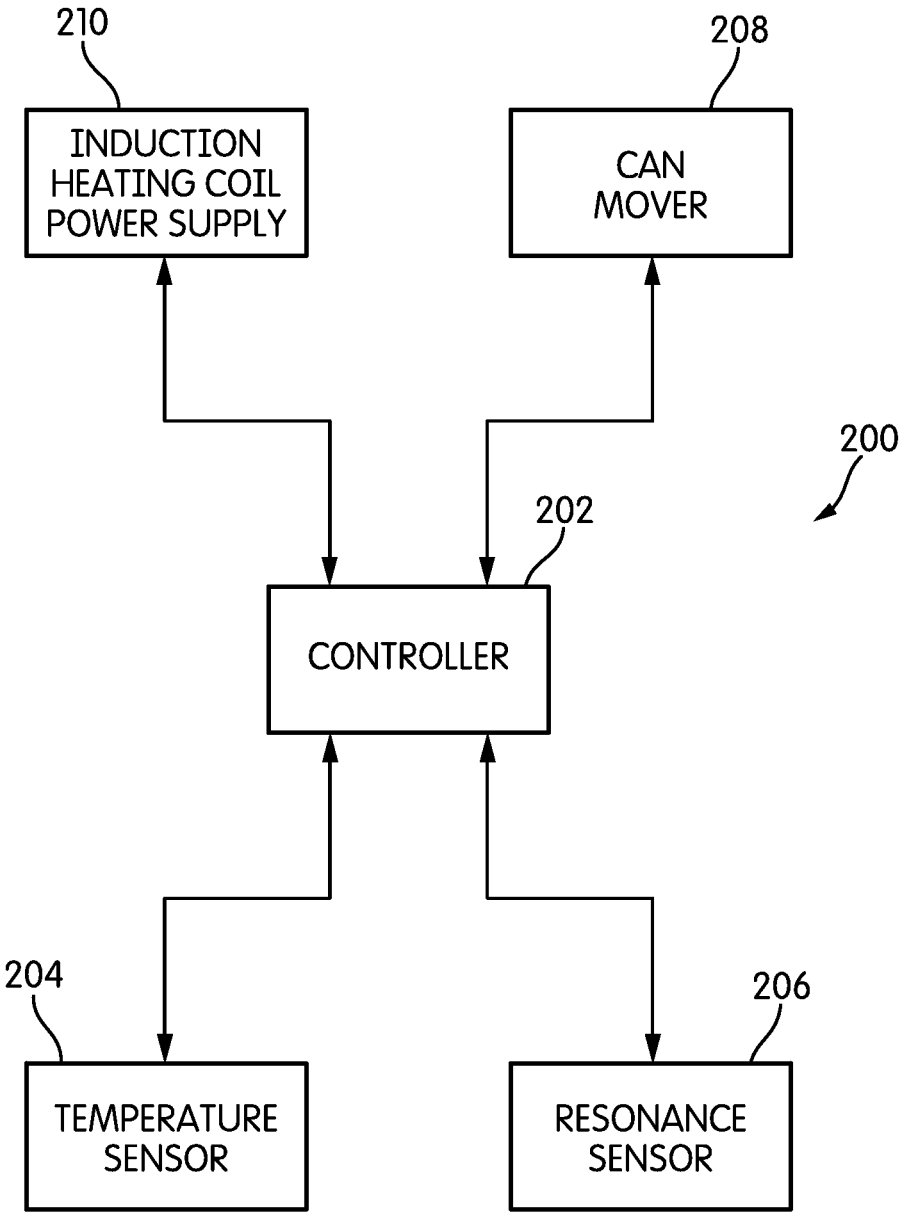
FIG. 12 is a diagram of a control system for a container heating system according to an exemplary embodiment.
Figure 13:
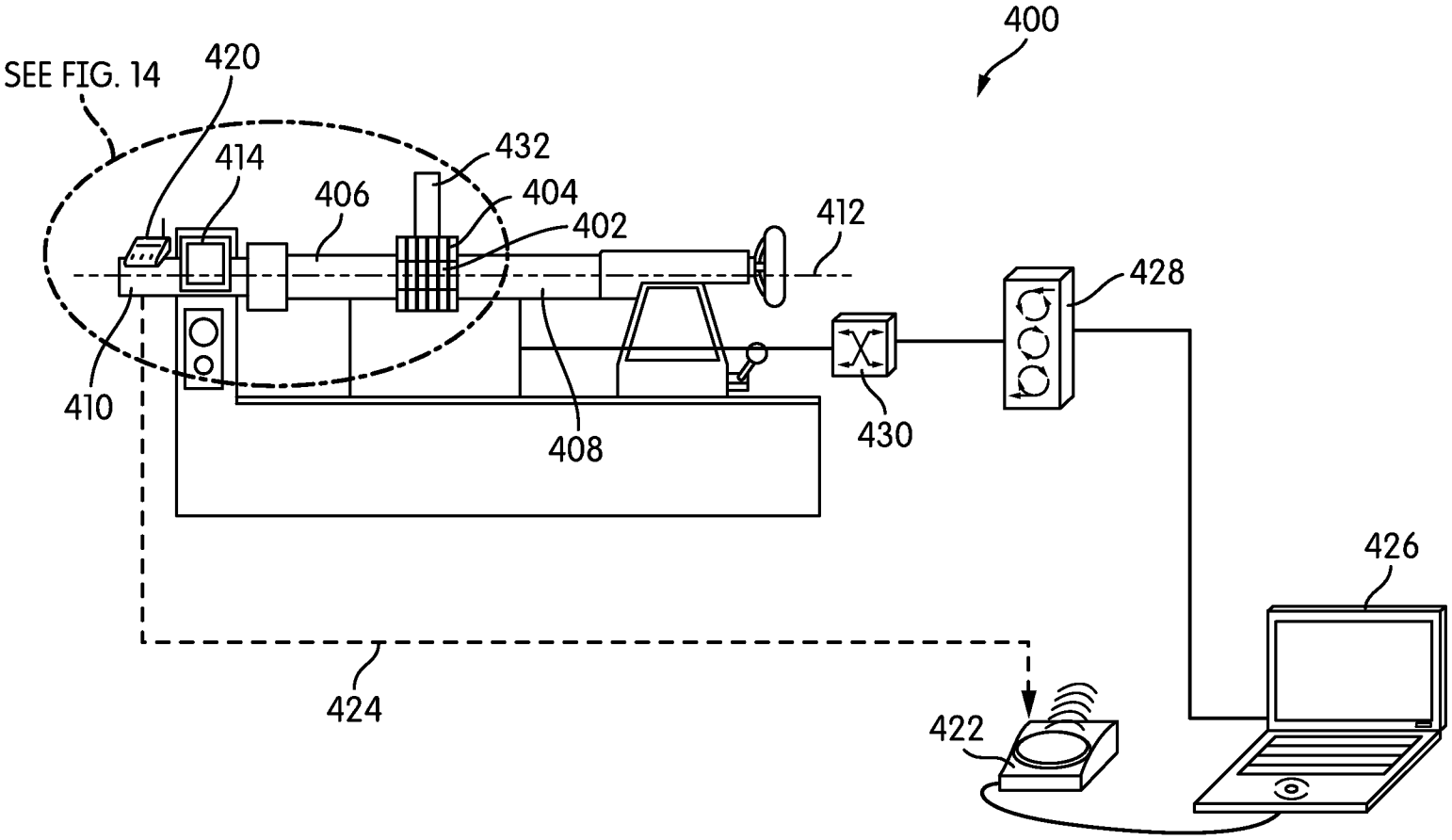
FIG. 13 is a temperature detecting system according to an exemplary embodiment.

Referring to FIG. 12, a diagram of a control system 200 configured to control can heating system 10 is shown according to an exemplary embodiment. Control system 200 includes a controller 202 coupled to one or more sensors, shown as temperature sensor 204 and resonance sensor 206. In various embodiments, resonance sensor 206 may include an oscilloscope. In another embodiment, resonance sensor 206 may include an ammeter, a frequency meter, and/or a Watt meter combined with appropriate hardware and/or software to determine resonance from the meters of resonance sensor 206. Controller 202 is also configured to generate and send control signals to a can mover 208 and an induction heating coil power supply 210. It should be understood that can mover 208 may be any device configured to move cans through an induction heating coil configured to heat, cook or sterilize metallic or metal food cans, and in various embodiments, includes any combination of conveyor 12, arm 102, turret 132, and conveyors 142 and 144. It should be understood that induction heating coil power supply may be any device or combinations of devices suitable for providing current to any of the induction heating coils discussed herein. The components of control system 200 are communicably coupled together by communication links 212 configured to transmit signals throughout control system 200 to provide the various functionalities discussed herein.

In one embodiment, controller 202 is configured to control the operation of can mover 208 and/or induction heating coil power supply 210 based on temperature information received from temperature sensor 204 to heat a can to the proper temperature and/or to maintain the can at the proper temperature for the proper amount of time. In such embodiments, control 202 receives a signal or data from temperature sensor 204 indicative of the temperature of the can being heated via a communication link 212.

In one embodiment, if controller 202 determines that the temperature of can 14 is above a threshold, controller 202 generates a control signal to can mover 208 and/or induction heating coil power supply 210 to reduce the temperature of can 14 being heated. In one such embodiment, controller 202 is configured to generate a control signal to control induction heating coil power supply 210 to lower the level of current supplied to the induction heating coil causing less heat to be applied to can 14. As another example, controller 202 is configured to generate a control signal to control induction heating coil power supply 210 to lower the frequency of the current supplied to the induction heating coil causing less heat to be applied to can 14. In one such embodiment, controller 202 is configured to generate a control signal to control can mover 208 to move can 14 faster through the induction heating coil (i.e., so that the can spends less time interacting with the magnetic field) and thereby causing less heat to be applied to can 14.

In addition, if controller 202 determines that the temperature of can 14 is below a threshold, controller 202 generates a control signal to can mover 208 and/or induction heating coil power supply 210 to increase the temperature of can 14 being heated. In one such embodiment, controller 202 is configured to generate a control signal to control induction heating coil power supply 210 to raise the level of current supplied to the induction heating coil causing more heat to be applied to can 14. In another such embodiment, controller 202 is configured to generate a control signal to control induction heating coil power supply 210 to increase the frequency of the current supplied to the induction heating coil causing more heat to be applied to can 14. In another embodiment, controller 202 is configured to generate a control signal to control can mover 208 to move can 14 slower through the induction heating coil (i.e., so that the can spends more time interacting with the magnetic field) and thereby causing more heat to be applied to can 14.

In one embodiment, temperature sensor 204 is a sensing device configured to sense the surface temperature of cans 14 with in the induction heating coil. In such an embodiment, the temperature threshold used by controller 202 is a can surface temperature threshold.

In one such embodiment, temperature sensor 204 is an infrared sensor or monitor. In one embodiment, can 14 may have a black colored sidewall and/or end walls (e.g., made from a black material, covered with a black coating, etc.) to enhance the visibility of the heat of the can to the infrared sensor or monitor. In such embodiments, temperature data from sensor 204 is received by controller 202 in real time, and controller 202 is configured to control can mover 208 and/or induction heating coil power supply 210 as needed in real time such that each can is heated as needed for a particular application.

In another embodiment, temperature sensor 204 may be a sensor located within the contents of can 14 being heated. In such embodiments the sensor may include a temperature sensing element and a memory for storing temperature readings made during the heating process. Because this internal sensing element is located within can 14 during heating, the internal sensing element will be exposed to any of the magnetic induction field that penetrates into the cavity of the can. Thus, in this embodiment, the internal sensor is designed to function within the magnetic induction field. In various embodiments, the internal sensor is made from non-metallic and/or electrically non-conductive materials. In addition, the internal sensor may include one or more shielding elements configured to shield the sensor components from the magnetic induction field.

In various embodiments, the internal temperature sensor 204 is a thermocouple sensor located within can 14, and controller 202 is configured to adjust operation of can mover 208 and/or induction heating coil power supply 210 based on the data received from the sensor. An exemplary embodiment of the internal temperature sensor 204, shown as internal sensor 220, is shown schematically in FIG. 8. As shown in FIG. 8, in one embodiment, sensor 220 is located at the geometric center point of the cavity or chamber of the can. In one such embodiment, the sensor directly reads the temperature of the can contents, and controller 202 varies the operation of can mover 208 and/or induction heating coil power supply 210 based on the received data. In one such embodiment, the data provided to controller 202 by the sensor is provided after the heating cycle has finished and thus is not real-time temperature data. In one embodiment, sensor 220 is a resistance temperature detecting sensor. In this embodiment, controller 202 is configured to adjust operation of can mover 208 and/or induction heating coil power supply 210 for future heating operations based on the data received from the thermocouple temperature sensor. In such embodiments, additional temperature readings may be taken following the adjustment to confirm that the adjustments result in subsequent cans being heated in conformance to the desired heating protocol. In various embodiments, an internal, thermocouple type sensor may be used for system verification, regulatory certification and/or for calibration.

In one embodiment, controller 202 is configured to control the operation of induction heating coil power supply 210 based on resonance information received from resonance sensor 206. In a specific embodiment, controller 202 may use data from resonance sensor 206 to control the frequency of current supplied to the induction heating coil to improve or maximize resistive heating within the body of the can being heated. In such embodiments, controller 202 receives a signal or data from resonance sensor 206 indicative of the level of resonance of the can being heated via a communication link 212, and controller 202 controls the heating coil (via control of induction heating coil power supply 210) to deliver the magnetic field at or near the resonant frequency of the can being heated.

In one embodiment, if controller 202 determines that the level of resonance of a can 14 being heated is less than a threshold, controller 202 generates a control signal to induction heating coil power supply 210 to adjust the frequency of current supplied to the induction heating coil to increase the level of resonance within the body of the can being heated. Increasing the level of resonance increases the level of resistive heating experienced by the body of can 14, which in turn results in more efficient heating of the contents of can 14.

In one embodiment, resonance sensor 206 is configured to provide real-time resonance data to controller 202 for cans 14 as they are heated within the system, and controller 202 is configured to adjust the frequency of current supplied by induction heating coil power supply 210 in real-time. In another embodiment, controller 202 is configured to determine and set the operating frequency of current supplied by induction heating coil power supply 210 based on resonance data received from resonance sensor 206 during a test or calibration run. Controller 202 may then be recalibrated each time a new type of can with different resonance properties is to be heated within system 10. In this manner system 10 may be used to efficiently heat different batches of cans 14 in which different batches of cans have different sizes, shapes, can body materials, can contents, etc. that may result in a different frequency being supplied by induction heating coil power supply 210 to provide the desired level of resonance.

As noted above, in some embodiments, the heating systems discussed herein include coils sized to hold a single can within each induction coil or unit (e.g., systems 130, 250 and 340), and in these embodiments, the system includes multiple induction coils or units. In such embodiments, controller 202 may configured to separately and individually control the coil holding the individual can (e.g., coils 134, coils 254, coils 346) to generate a magnetic field (and consequently can heating) based upon one or more specific characteristic of the can. For example, controller 202 may be configured to control the coil based upon can shape, can size, can body material and/or can contents to heat the can following a particular heating protocol for that can type or content type. In one such embodiment, the can (such as can 14) includes an ID tag (e.g., a barcode, RF ID tag, structural landmark, etc.) detected by a sensor of control system 200 (e.g., a barcode reader, RF ID reader, vision system, etc.). The ID tag provides information to controller 202 about one or more relevant characteristics of the can (e.g., can shape, can size, can body material and/or can contents, etc.), and controller 202 is then configured to control operation of the coil based on the can within the coil. Thus, this embodiment, controller 202 in combination with individual can coils, allows each can 14 to be heated using a different heating protocol based on the particular can within the coil. This configuration may eliminate the need to segregate cans based on size or content type and to process the cans in batches according to size or content type, as is typical using steam retort processing.

Controller 202 may be a general purpose processor, an application specific processor (ASIC), a circuit containing one or more processing components, a group of distributed processing components, a group of distributed computers configured for processing, etc., configured to provide the functionality of control system 200. Controller 202 may include or have access to one or more devices for storing data and/or computer code for completing and/or facilitating the various processes described in the present application. Such storage devices may include volatile memory, non-volatile memory, database components, object code components, script components, and/or any other type of information structure for supporting the various functions of control system 200 described herein. Communication links 212 may be wired or wireless communication links and may use either standard or proprietary communications protocols, and controller 202 is configured with appropriate hardware and/or software for communicating within system 200.

Referring to FIGS. 13-16, a temperature detection system 400 is shown according to an exemplary embodiment. Temperature detection system 400 is configured to measure the real-time temperature of the contents inside a can, shown as can 402, as can 402 is heated within induction coil 404. In one embodiment, real-time temperature measurement includes temperature readings that are stored, recorded, processed or displayed less than one second after the temperature is sensed. In another embodiment, real-time temperature measurement includes temperature readings that are stored, recorded, processed or displayed while can 402 remains within coil 404 during heating and/or cooling within coil 404. In one embodiment, temperature detection system 400 generates temperature data indicative of the temperature within can 402 that is used to confirm that contents of can 402 have been heated to the sterilization temperature within induction coil 404. This data may then be used or submitted to obtain regulatory approval of an induction heating system for production of canned or packaged food products.

Similar to the coils discussed above, an alternating current at one or more different frequencies is supplied to coil 404 to generate an alternating magnetic field which in turn induces current in the material of the sidewall and/or end walls of can 402. The induced current causes resistive heating of the material of the sidewall and/or end walls of cans 402 which in turn acts to heat the contents of cans 402 to the desired temperature. System 400 is configured to measure the temperature to confirm that the desired temperature has been reached. In one embodiment, the desired temperature is the sterilization temperature for the contents of can 402. Further, coil 404 may be any of the coil arrangements discussed herein.

Can 402 is supported between two rotatable, restraint or support structures, shown as supports 406 and 408. Supports 406 and 408 function similarly to support structures 150 and 152 above, and provide rotation to can 402 while within induction coil 404. In various embodiments, system 400 is configured (e.g., coil 404 and the motion provided by supports 406 and 408) to mimic the heating characteristics of each of the heating system and coil arrangements discussed above allowing system 400 to generate temperature data accurate enough to verify that the contents of the heated cans reach the sterilization temperature.

A rotating spindle 410 is rigidly coupled to support 406 such that rotating spindle 410 and support 406 rotate together about axis 412. Thus, as support 406 spins to rotate can 402 within coil 404, as discussed above, spindle 410 also rotates. Spindle 410 extends through a rotational bracket 414 that rotationally supports both spindle 410 and support 406 such that spindle 410 and support 406 are permitted to rotate relative to bracket 414.

System 400 is configured to measure temperature within can 402 in real-time while both can 402 is within the energized induction coil 404 and while can 402 is spinning within coil 404. In the embodiment shown, system 400 includes a communication device, shown as wireless transmitter 420. In one embodiment, transmitter 420 is based on Xbee wireless module. Transmitter 420 is rigidly coupled to spindle 410 such that transmitter 420 rotates with spindle 410 and support 406 as can 402 is rotated.

Generally, transmitter 420 is coupled to a temperature sensing device configured to read the real-time temperature of the contents of can 402 during heating within coil 404, and transmitter 420 is configured to receive a signal indicative of the real-time temperature from the sensor. Transmitter 420 is configured to communicate data indicative of the real-time temperature to a receiver, shown as wireless receiver 422, via communication link 424. In one embodiment, a standard wireless communication protocol is used and in another embodiment, a proprietary wireless communication protocol is used. Wireless receiver 422 is coupled to a computer 426. Computer 426 is configured to store and process the received real-time temperature data. In one embodiment, computer 426 includes one or more memory device to store the real-time temperature data received from temperature sensing device. In one embodiment, computer 426 is configured to display a graph of the real-time temperature data versus time.

In the embodiment shown, computer 426 is configured to communicate the real-time temperature data to controller 428. In one embodiment, controller 428 is in direct communication with wireless receiver 422 and is configured to receive and process data indicative of the real-time temperature directly from wireless receiver 422. Controller 428 is configured to control the operation of coil 404 and/or the rotational speed of can 402 based on the received data indicative of the real-time temperature within can 402. Controller 428 may be configured to control operation of coil 404 in a manner similar to controller 202, and controller 428 may be configured to control rotation of can 402 by controlling a motor that spins supports 406 and 408. Controller 428 may be configured to adjust the operation of coil 404 as discussed above regarding controller 202. In the embodiment shown, an electrically operated switch or optical isolator 430 is located between controller 428 and coil transformer 432 to supply the higher voltages and currents needed to control coil 404 based on a control algorithm to provide the functionality described herein.

Figure 14:
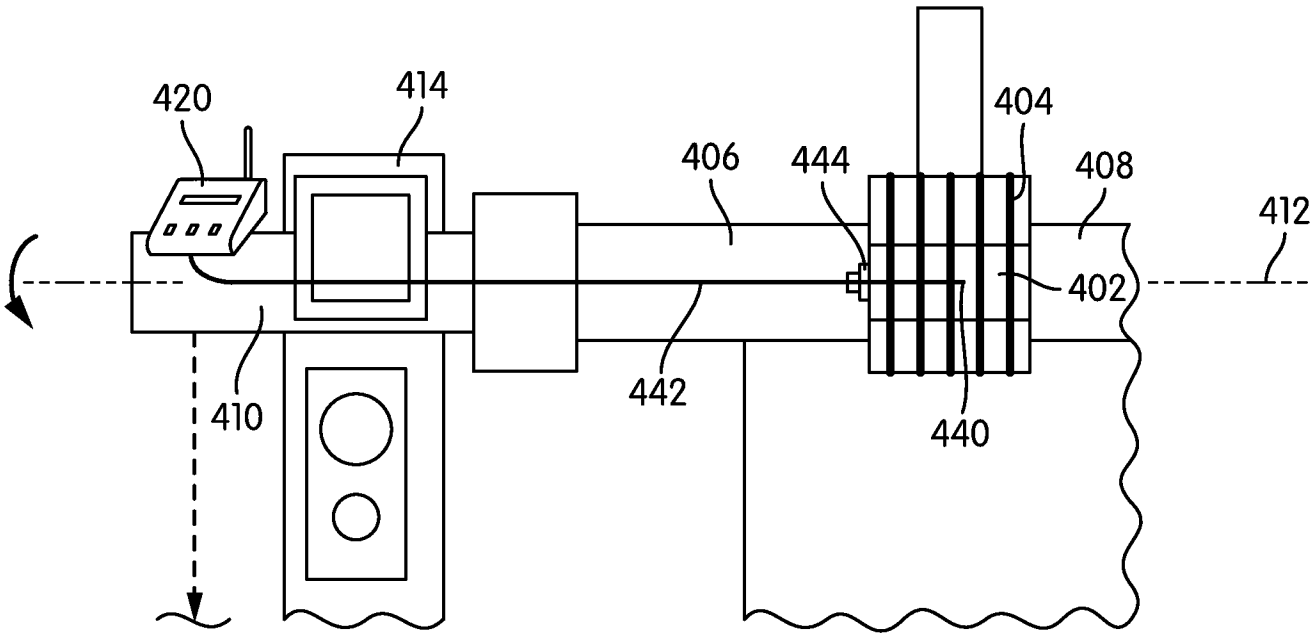
FIG. 14 is an enlarged view of a portion of the temperature detecting system of FIG. 13.

Referring to FIG. 14, a detailed view of the portion of system 400 including the temperature sensor is shown according to an exemplary embodiment. System 400 includes a temperature sensor, shown as probe 440. Probe 440 is located within can 402. As discussed in more detail below, probe 440 includes a temperature sensing element that is located in the geometric center of can 402. Probe 440 is coupled to a wire or lead 442 that transmits a signal indicative of the temperature of the contents of can 402 to wireless transmitter 420. As discussed above, wireless transmitter 420 then transmits the signal or data indicative of the sensed temperature to computer 426 via receiver 422.

As shown, spindle 410 and support 406 both include hollow central channels within which lead 442 is located to extend from can 402 to wireless transmitter 420. Probe 440 and lead 442 are rigidly coupled to can 402 via fastener 444. As discussed in more detail regarding FIGS. 15 and 16, fastener 444 rigidly couples probe 440 and lead 442 to can 402 such that can 402, support 406, spindle 410, wireless transmitter 420, probe 440 and lead 442 at the same pace and/or together (same rotational phase and position).

Figure 15:
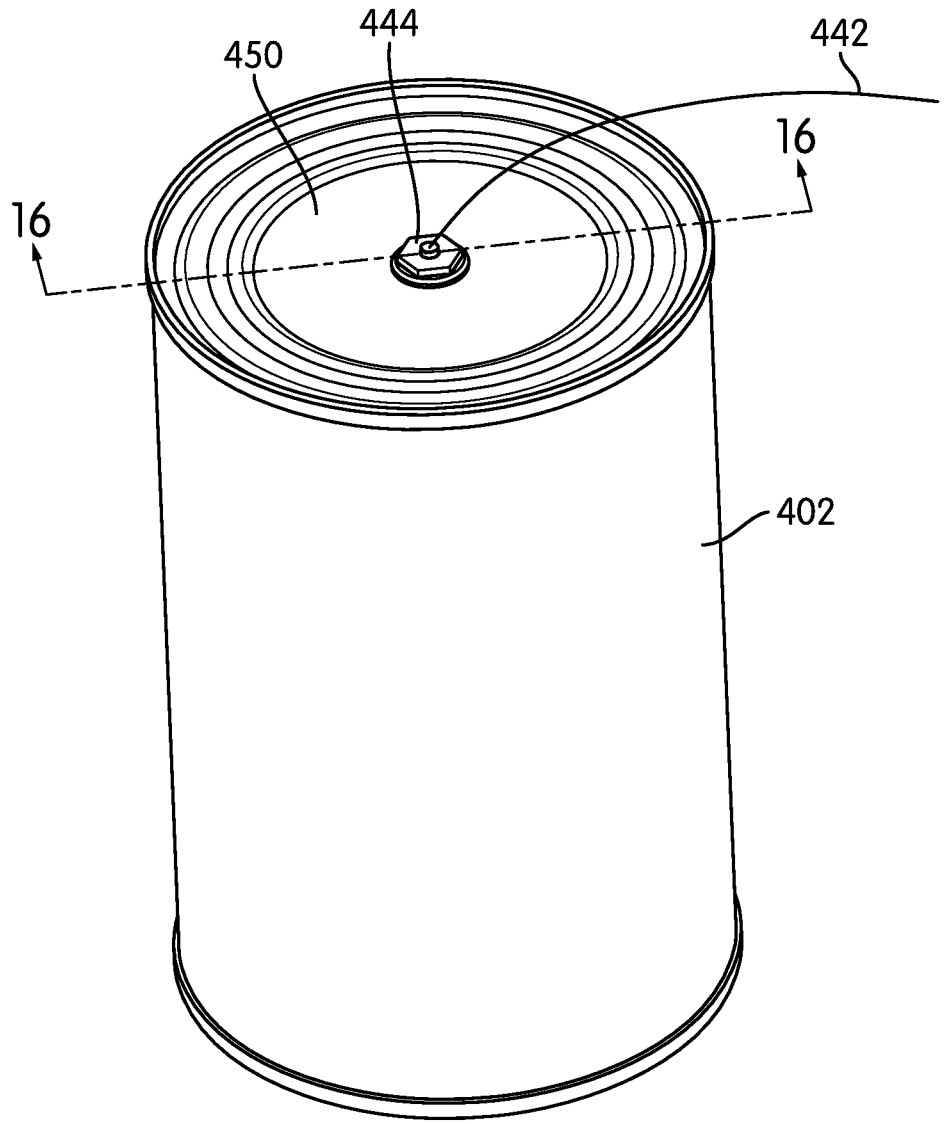
FIG. 15 is a can for use in the temperature detecting system of FIG. 13 according to an exemplary embodiment.
Figure 16:
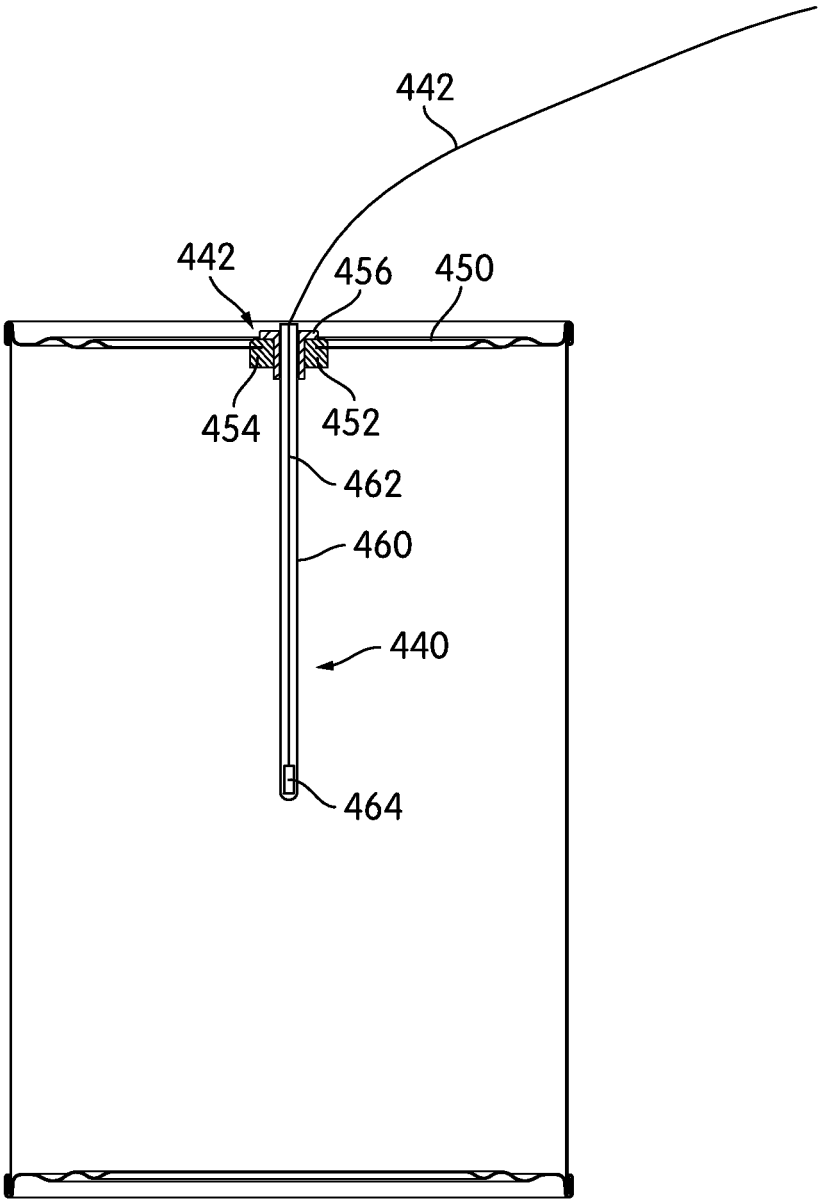
FIG. 16 is a cross-sectional view of the can of FIG. 15.

Referring to FIG. 15 and FIG. 16, can 402 with inserted temperature probe 440 is shown according to an exemplary embodiment. Fastener 444 extends through end wall 450 of can 402 and provides the rigid coupling and hermetic seal between probe 440, lead 442 and can 402. In the embodiment shown, fastener 444 includes a rivet 452 located through the center point of end wall 450. Fastener 444 provides a hermetic coupling to end wall 450 such that the contents of can 402 are not permitted to leak or escape around fastener 444 during heating within system 400.

Rivet 452 extends through a hole created through end wall 450 and includes a circumferential slot 454. As shown in FIG. 16, the inner edge of end wall 450 adjacent rivet 452 is received within circumferential slot 454, and circumferential slot 454 is clamped or crimped onto end wall 450 to rigidly couple rivet 452 to end wall 450. Rivet 452 includes a central through bore or channel defining a threaded inner surface. Fastener 444 also includes a bolt 456. Bolt 456 includes a threaded outer surface that threads into and rigidly engages bolt 456 to rivet 452. Bolt 456 includes a central through bore or channel, and temperature probe 440 extends through the central channel of bolt 456.

In one embodiment, rivet 452 and bolt 456 are formed from a non-electrically conductive material. In another embodiment, rivet 452 and bolt 456 are formed from a material with a low magnetic permeability when compared to the magnetic permeability of the material of can 402. In one such embodiment, rivet 452 and bolt 456 are formed from aluminum, and the end wall and sidewall of can 402 are formed from a steel material.

As shown in FIG. 16, probe 440 includes an outer sheath 460. Outer sheath 460 is formed from a non-electrically conductive material. The outer surface of sheath 460 is rigidly coupled to the inner surface of the central channel of bolt 456. In one embodiment, an adhesive bonds the outer surface of sheath 460 to the inner surface of the central channel of bolt 456. Sheath 460 includes a hollow central cavity, and an inner wire or lead 462 is located within the central cavity of sheath 460. Inner lead 462 is coupled to lead 442, and in the embodiment shown, is integral with lead 442. Inner lead 462 extends from lead 442 to a sensing element 464 located near the inner or distal tip of sheath 460. Sensing element 464 is located in the geometric center of can 402 such that sensing element 464 is positioned to read the temperature of the contents of can 402 at the coolest point. Sheath 460 is hermetically sealed around sensing element 464 and inner lead 462 to protect these elements from damage that may occur during installation and handling or that may occur due to corrosion caused by the contents of can 402.

In one embodiment, bolt 456 is permanently coupled to sheath 460. This embodiment permits easy re-use of probe 440 to provide temperature readings for multiple cans 402. In such embodiments, for each can 402 to be heated within coil 404, a rivet 452 is installed through the end wall of the can to be heated. Then probe 440 and bolt 456 is inserted through the central channel of rivet 452 until the lower most end of bolt 456 reaches the central channel of rivet 452. Next, bolt 456 is threaded into the central channel of rivet 452, and once bolt 456 is fully engaged with rivet 452, lead 442 is coupled to wireless transmitter 420. Following heating of can 402 and reading of the temperature data, the coupling process is reversed to decouple probe 440 from can 402 allowing probe 440 to be used to measure the temperature of the next can to be heated within system 400.

Probe 440 is a sensor configured to generate a signal indicative of the temperature within the contents of can 402 during heating by coil 404. In one embodiment, probe 440 is a resistance temperature detector probe. In one specific embodiment, probe 440 is a platinum based resistance temperature detecting probe in which sensing element 464 is formed from platinum. In another embodiment, probe 440 is a thermocouple, a fiber optic sensor, or a similar temperature detector, which generates an electric signal, an optical signal, an acoustic signal, or mechanical stress/strain signal that varies with temperature in a known relationship.

Figure 17:
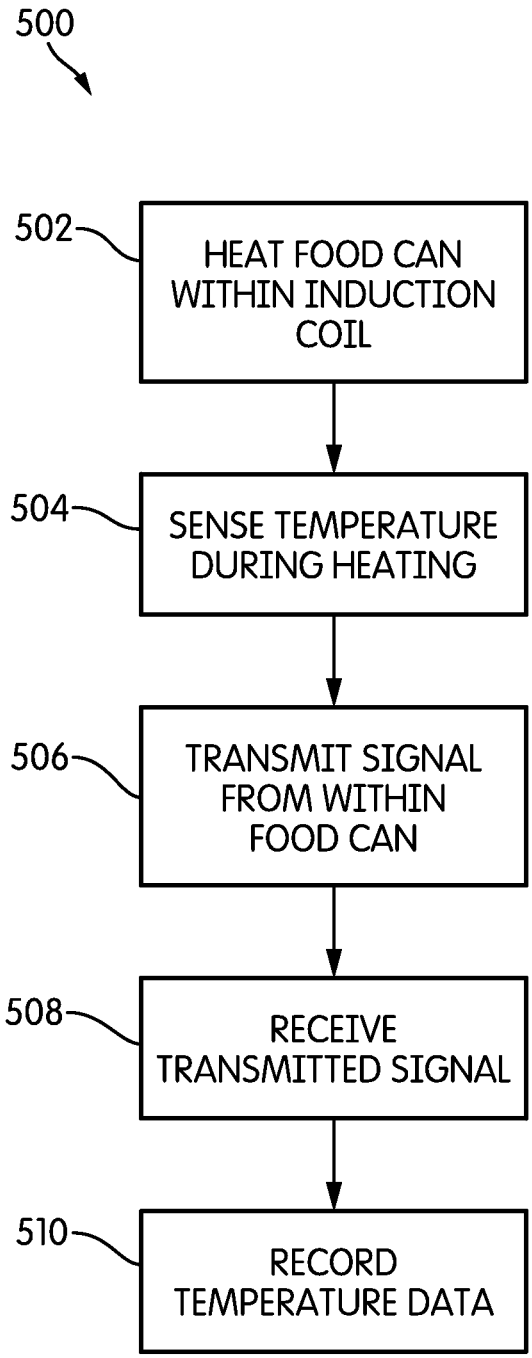
FIG. 17 is flow-diagram showing a temperature detection method according to an exemplary embodiment.

Referring to FIG. 17, a method of detecting temperature during induction heating of a filled and hermetically sealed metal food can 500 is shown, according to an exemplary embodiment. In one embodiment, method 500 is performed using the system and method described above in relation to FIGS. 13-16. At step 502, the sealed metal food can and the food within the can is heated using a magnetic field generated by an induction coil. At step 504, the temperature of the food within the sealed metal can is sensed or detected while the can is being heated within the magnetic field. At step 506, a signal indicative of the sensed temperature is transmitted out of the sealed food can and out of the magnetic field. At step 508, the transmitted signal is received by a receiver. At step 510, data indicative of the temperature of the food is recorded, for example in computer memory. In one embodiment, data indicative of the sensed temperature is displayed via display device or computer coupled to the receiver. In another embodiment, receiver 422 includes a built in display screen (e.g., LCD screen) configured to display data indicative of the sensed temperature.

According to exemplary embodiments, the containers or cans discussed herein may be formed of any material that may be heated by induction, and in specific embodiments, the containers discussed herein are cans formed from stainless steel, tin-coated steel or tin-free steel (TFS).

Cans and containers discussed herein may include containers of any style, shape, size, etc. For example, the containers discussed herein may be shaped such that cross-sections taken perpendicular to the longitudinal axis of the container are generally circular. However, in other embodiments the sidewall of the containers discussed herein may be shaped in a variety of ways (e.g., as having other non-polygonal cross-sections (oval, elliptical, etc.), as a rectangular prism, a polygonal prism, any number of irregular shapes, etc.) as may be desirable for different applications or aesthetic reasons. In various embodiments, the sidewall of cans 14 may include one or more axially extending sidewall sections that are curved radially inwardly or outwardly such that the diameter of the can is different at different places along the axial length of the can, and such curved sections may be smooth continuous curved sections. In one embodiment, cans 14, such as can 154, may be hourglass shaped. Cans 14 may be of various sizes (e.g., 3 oz., 8 oz., 12 oz., 15 oz., 28 oz, etc.) as desired for a particular application.

Further, a container may include a container end wall (e.g., a closure, lid, cap, cover, top, end, can end, sanitary end, "pop-top", "pull top", convenience end, convenience lid, pull-off end, easy open end, "EZO" end, etc.). The container end wall may be any element that allows the container to be sealed such that the container is capable of maintaining a hermetic seal. In an exemplary embodiment, the upper can end may be an "EZO" convenience end, sold under the trademark "Quick Top" by Silgan Containers Corp.

The upper and lower end walls shown in FIGS. 7 and 8 are can ends or end panels coupled to the can body via a "double seam" formed from the interlocked portions of material of the can sidewall and the can end. However, in other embodiments, the end walls discussed herein may be coupled to the sidewall via other mechanisms. For example, end walls may be coupled to the sidewall via welds or solders. As shown above, the containers discussed herein are three-piece cans having an upper can end (e.g., an upper can end panel), a lower can end (e.g., an upper can end panel) and a sidewall each formed from a separate piece of material. However, in other embodiments, a two-piece can (i.e., a can including a sidewall and an end wall that are integrally formed and a separate can end component joined to the sidewall via a double seam) may be heated via an induction heating system as discussed herein.

In various embodiments, the upper can end wall may be a closure or lid attached to the body sidewall mechanically (e.g., snap on/off closures, twist on/off closures, tamper-proof closures, snap on/twist off closures, etc.). In another embodiment, the upper can end wall may be coupled to the container body via the pressure differential. The container end wall may be made of metals, such as steel or aluminum, metal foil, plastics, composites, or combinations of these materials. In various embodiments, the can end walls, double seams, and sidewall of the container are adapted to maintain a hermetic seal after the container is filled and sealed.

The containers discussed herein may be used to hold perishable materials (e.g., food, drink, pet food, milk-based products, etc.). It should be understood that the phrase "food" used to describe various embodiments of this disclosure may refer to dry food, moist food, powder, liquid, or any other drinkable or edible material, regardless of nutritional value. In other embodiments, the containers discussed herein may be used to hold non-perishable materials or non-food materials. In various embodiments, the containers discussed herein may contain a product that is packed in liquid that is drained from the product prior to use. For example, the containers discussed herein may contain vegetables, pasta or meats packed in a liquid such as water, brine, or oil.

According to various exemplary embodiments, the inner surfaces of the upper and lower end walls and the sidewall may include a liner (e.g., an insert, coating, lining, a protective coating, sealant, etc.). The protective coating acts to protect the material of the container from degradation that may be caused by the contents of the container. In an exemplary embodiment, the protective coating may be a coating that may be applied via spraying or any other suitable method. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, EVOH and/or other suitable lining material or spray. The interior surfaces of the container ends may also be coated with a protective coating as described above.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A metallic food can heating system configured to heat a plurality of filled and sealed metallic food cans comprising:

an induction heating coil defining an internal lumen having a longitudinal axis, the internal lumen configured to receive the metallic food cans during heating, the induction coil configured to generate an alternating magnetic field causing resistive heating of the metallic material of the food can;

a can moving device configured to move cans into the induction heating coil prior to induction heating, to move cans while within the induction heating coil and to move cans out of the induction heating coil after induction heating;

an electrical induction power supply configured to supply alternating current to the induction heating coil;

a preheating chamber located before the induction heating coil;

a cooling chamber located after the induction heating coil;

a coil cooling system configured to cool the induction heating coil;

a first conduit configured to transfer heat from the cooling chamber to the preheating chamber; and a second conduit configured to transfer heat from the coil cooling system to the preheating chamber;

wherein each can has a longitudinal axis, wherein each can is positioned within the lumen of the induction coil such that the longitudinal axis of each can is substantially perpendicular to the longitudinal axis of the internal lumen of the induction heating coil.

2. An induction heating system configured to sequentially heat a plurality of filled and sealed food containers comprising:

an unpressurized heating chamber including an induction heating coil defining a lumen having a longitudinal axis, the lumen configured to receive the containers during heating, the induction coil configured to generate an alternating magnetic field causing resistive heating of the container;

a container moving device configured to move containers into the induction heating coil lumen prior to induction heating, to move containers while within the induction heating coil lumen and to move containers out of the induction heating coil lumen after heating;

a passively heated preheating chamber located before the unpressurized heating chamber;

a cooling chamber located after the unpressurized heating chamber; and a first support structure configured to engage a first end wall of the container and a second support structure configured to engage a second end wall of the container within the induction heating coil lumen during heating of the container, wherein the first and second support structures exert an inwardly directed force on the end walls to resist outward deformation of the end wall during heating.

3. The induction heating system of claim 2 wherein the support structure is made from an electrically non-conductive material.

4. The induction heating system of claim 3 wherein the electrically non-conductive material is a polymer material.

5. The induction heating system of claim 4 wherein the support structure is configured to rotate each container about the longitudinal axis of the container within the induction heating coil lumen during heating of the container.

6. The induction heating system of claim 5 wherein the support structure is configured to rotate each of the containers at a rate between 50 rpm and 600 rpm.

7. An induction heating system configured to sequentially heat a plurality of filled and sealed food containers comprising:

an unpressurized heating chamber including an induction heating coil defining a lumen having a longitudinal axis, the lumen configured to receive the containers during heating, the induction coil configured to generate an alternating magnetic field causing resistive heating of the container;

a container moving device configured to move containers into the induction heating coil lumen prior to induction heating, to move containers while within the induction heating coil lumen and to move containers out of the induction heating coil lumen after heating;

at least one support structure configured to engage an end wall of the container within the induction heating coil lumen during heating of the container, wherein the support structure resists outward deformation of the end wall during heating;

a preheating chamber located before the unpressurized heating chamber;

a cooling chamber located after the unpressurized heating chamber;

a coil cooling system configured to cool the induction heating coil;

a first conduit configured to transfer heat from the cooling chamber to the preheating chamber; and a second conduit configured to transfer heat from the coil cooling system to the preheating chamber.

8. A metallic food can heating system configured to heat a plurality of filled and sealed metallic food cans comprising:

an induction heating coil defining an internal lumen having a longitudinal axis, the induction coil inducing electric currents to cause resistive heating in metallic food cans contained within the internal lumen, when the electric coil is energized, a can moving device configured to move cans into the induction heating coil prior to induction heating, to move cans while within the induction heating coil and to move cans out of the induction heating coil after induction heating;

an electrical induction power supply coupled to the induction heating coil and configured to supply alternating current to the induction heating coil; and a plurality of first support structures configured to engage an upper end wall of each of the plurality of cans, and a plurality of second support structures configured to engage a lower end wall of each of the plurality of cans, wherein the first and second support structures engage the upper and lower end walls of each of the plurality of cans while the cans are within the internal lumen of the induction heating coil, wherein the first and second support structures resist outward deformation of the upper and lower end walls during heating of the plurality of cans;

wherein the plurality of first support structures and the plurality of second structures are configured to exert an inwardly directed force on the upper and lower end walls, respectively, of each of the plurality of cans; and wherein each can has a longitudinal axis, wherein a majority portion of each can is positioned within the lumen of the induction coil such that the longitudinal axis of each can is substantially perpendicular to the longitudinal axis of the internal lumen of the induction heating coil.

* * * * *